US005284438A

United States Patent [19]

McGill et al.

[11] Patent Number: 5,284,438

[45] Date of Patent: Feb. 8, 1994

[54] MULTIPLE PURPOSE BURNER PROCESS AND APPARATUS

[75] Inventors: Eugene C. McGill, Skiatook; Lee R. Massey, Tulsa; William C. Gibson, Tulsa; David W. Schmitt, Tulsa, all of Okla.

[73] Assignee: Koch Engineering Company, Inc., Wichita, Kans.

[21] Appl. No.: 817,877

[22] Filed: Jan. 7, 1992

[51] Int. Cl.[5] ..... F23L 9/00

[52] U.S. Cl. ..... 431/9; 431/8; 431/116

[58] Field of Search ..... 431/115, 116, 159, 181, 431/187, 188, 8, 9, 10, 285

[56] References Cited

U.S. PATENT DOCUMENTS

| | | | |
|---|---|---|---|
| 3,273,621 | 9/1966 | Childree . | |
| 3,590,821 | 11/1970 | Siegmund et al. | 431/116 |
| 3,985,494 | 10/1976 | Childree | 431/175 |
| 4,277,942 | 7/1981 | Egnell et al. | 60/517 |
| 4,445,843 | 5/1984 | Nutcher | 431/190 X |
| 4,496,306 | 1/1985 | Okigami et al. | 431/8 |
| 4,505,666 | 3/1985 | Martin et al. | 431/175 |
| 4,575,332 | 3/1986 | Oppenberg et al. | 431/9 |
| 4,629,413 | 12/1986 | Michelson et al. | 431/188 X |
| 4,695,929 | 6/1978 | McCartney | 431/188 X |
| 4,708,638 | 11/1987 | Brazier et al. | 431/116 |
| 5,044,932 | 9/1991 | Martin et al. | 431/116 |
| 5,073,105 | 12/1991 | Martin et al. | 431/116 |
| 5,098,282 | 3/1992 | Schwartz et al. | 431/9 |

FOREIGN PATENT DOCUMENTS

| | | | |
|---|---|---|---|
| 3048201 | 7/1982 | Fed. Rep. of Germany | 431/9 |
| 0071735 | 6/1977 | Japan | 431/115 |
| 0023871 | 2/1980 | Japan | 431/9 |
| PCT/GB89/-01252 | 10/1989 | PCT Int'l Appl. . | |
| 0779381 | 11/1980 | U.S.S.R. | 431/116 |
| 1588987 | 8/1990 | U.S.S.R. | 431/115 |

*Primary Examiner*—Carl D. Price

*Attorney, Agent, or Firm*—Dougherty, Hessin, Beavers & Gilbert

[57] ABSTRACT

A multiple purpose burner process and apparatus in which a burner assembly having a burner member defining a burner throat bore extending therethrough and forming an ignition zone and at least one mixing zone in the burner throat bore, the total combustion air passing through the burner throat bore. A minor portion of fuel gas as ignition fuel produces a continuous ignition flame in the ignition zone, and plural meter channels extending through the burner member communicate with the mixing zone to pass an admixture of a diluent gas with the remainder portion of the fuel, as a primary fuel stream, to the mixing zone for forming with the remaining combustion air a primary fuel/diluent/combustion air mixture, and the primary fuel/diluent/combustion air mixture is ignited by the ignition flame in the mixing zone. Diluents can be internally recirculating flue gas or can be from an external source, and the flame envelope achieved by the burner assembly can be variously shaped for an industrial combustion application as required.

29 Claims, 15 Drawing Sheets

MULTIPLE PURPOSE BURNER PROCESS AND APPARATUS

BACKGROUND OF THE INVENTION

1. Field of the Invention

The present invention relates to the field of combustion, and more particularly but not by way of limitation, to a multiple purpose combustion process and apparatus for substantially inhibiting the generation of deleterious constituents such as nitrogen oxides and carbon monoxide in combustion effluents.

2. Discussion of Prior Art

The permissible amount of certain compounds in industrially vented glass is regulated by various governmental agencies, especially in highly populated areas where air quality is adversely affected by the combustion of hydrocarbon fuels. Among such controlled emissions are the oxides of nitrogen, known to produce smog, and carbon monoxide, both of which are pollutants emitted during the combustion of industrial fuels.

In every combustion process where oxygen and nitrogen are present, high flame temperatures result in the fixation of oxides of nitrogen. Such compounds occur in flue gases mainly as nitric oxide (NO), with lesser amounts of nitrogen dioxide ($NO_2$), nitrous oxide ($N_2O$) and other oxides. Since nitric oxide continues to oxidize to nitrogen dioxide in air at ordinary temperatures, the total amounts of nitric oxide, nitrogen dioxide and other oxides of nitrogen in a flue gas effluent are commonly referred to collectively as nitrogen oxides, or $NO_x$, and expressed as $NO_2$.

The nitrogen oxides formed in combustion processes include fuel $NO_x$ (resulting from oxidation of nitrogen compounds in certain fuels); prompt $NO_x$ (a baseline of nitrogen oxides promptly formed in normal combustion of hydrocarbon fuels in air); and thermal $NO_x$ (produced from high combustion temperatures in air). It is the generation of this thermal $NO_x$ which the present invention effectively inhibits.

Combustion reactions that produce thermal $NO_x$ also produce carbon monoxide (CO), and attempts to reduce such $NO_x$ production can actually lead to an increase in CO emissions. Early air quality standards recognized the need for the control of $NO_x$ emissions, but largely ignored the CO content of stack gases. When more recent air quality standards placed limits on both $NO_x$ and CO emissions in stack gases, many of the prior art processes and apparatuses designed to reduce $NO_x$ were no longer acceptable solutions to effectively control these deleterious emissions.

As air quality standards have broadened to include CO emission limits, no lesser emphasis has been given to $NO_x$ emission levels. In fact, the limit on the latter has been decreased dramatically. Where in the past many considered $NO_x$ emissions of between about 40 to 60 ppm as being good control (as reflected by prior art developments in this area of technology), much more stringent control of $NO_x$ emissions are now required in many areas of this country. For example, the South Coast Air Quality Management District of California, the regulatory agency over the Los Angeles Basin, has set $NO_x$ emissions at not to exceed 0.03 lbs/MM Btus—roughly 25 parts per million by volume dry—a $NO_x$ level unachieveable by most prior art combustion apparatuses now operating or available, or where achievable, only for a narrow range of operating conditions. These same air quality standards require that CO emissions do not exceed about 100 parts per million.

Over the years, changing air quality standards have lead to considerable prior art efforts to provide apparatuses that remove or prevent the formation of pollutants so that flue gases generated as a result of combustion processes are dischargeable to the atmosphere with minimal deleterious effects on the environment. Generally, these prior art attempts have been toward either preventing the formation of $NO_x$ during the combustion process or controlling $NO_x$ emissions with post combustion treatments. But, as stated, prior art attempts to minimize $NO_x$ emissions have often resulted in the production of unacceptable limits of other deleterious pollutants.

It is known that thermal $NO_x$ formation can be reduced by lowering the flame temperature and delaying combustion, as by injecting an inert gas such as steam into the combustion zone. However, prior art processes and apparatuses which practice inert gas injection to lower flame temperature, generally encounter high carbon monoxide production (above 100 ppmvd) and flame instability. That is, the lower flame temperatures provide higher CO emissions, and the inert gas rates required to effect $NO_x$ reduction also cause the air/fuel/inert gas mixture to fall outside of the flammability limits of the mixture at times, causing flame instability which is manifested as a flame out, a condition which cannot be tolerated in combustion operations.

One prior art teaching in this field is that found in U.S. Pat. No. 4,496,306, issued to Okigami et al. In the Okigami burner assembly primary fuel and air are injected at an inlet end of a furnace where the primary fuel is burned in a first combustion zone. Air is supplied to this zone at a rate required for the combustion of the total fuel. Secondary fuel is injected at a second combustion zone in the furnace at a location spaced downstream from the first combustion zone. The secondary fuel is exposed to random dilution with surrounding combustion products prior to combusting in the furnace with excess oxygen from the first combustion zone.

U.S. Pat. No. 4,095,929, issued to McCartney, teaches a burner assembly for burning a product gas having a low heating value. Recognizing that variations in fuel composition lead to undesirable flame stability under conditions of low load, the burner assembly is provided with an oversized throat, and the fuel and air are each divided into two streams. All of the combustion air is passed through the oversized burner throat as primary and secondary air streams that are both needed at high loads. Primary fuel is supplied through the burner throat by a gas gun, and the remainder portion of the fuel, bypassing the burner throat, is supplied downstream as secondary fuel through an annulus surrounding the throat. Under conditions of low load, both the secondary air through the throat and the secondary fuel are shut off, with the purpose of sustaining adequate turbulence at low loading in order to maintain flame stability. Thus, flame stability rather than $NO_x$ generation controls the design criteria.

As mentioned, inert gas has been employed in combustion processes, and some have employed external flue gas recirculation in an attempt to control the formation of $NO_x$ during combustion of fuels. That is, a portion of the flue gas generated by combustion is collected and mixed with the inlet air fed to the burner. An example of such a process is disclosed in U.S. Pat. No. 4,445,843 issued to Nutcher.

A premix burner which delays the mixing of secondary air with the combustion flame and allows flue gas to mix with the secondary air is taught by U.S. Pat. No. 4,629,413, issued to Micheson et al. A fuel jet eductor entrains primary air to pass a sub-stoichiometric air/fuel mixture to a centrally disposed burner tip, while secondary air is dispensed from an annular space formed about the burner. Small amounts of flue gas are entrained into the fuel rich flame, purportedly providing cooling and dilution of the flame. The patent discusses $NO_x$ emission levels of between about 40 to 120 ppmvd.

Many of the problems inherent in the processes and apparatuses of the prior art for reducing $NO_x$ emissions have been obviated by the burner assembly disclosed in our U.S. Pat. No. 5,044,932 in which a burner tile is disposed about a central fuel nozzle and an air inlet port. Secondary fuel nozzles are disposed peripherally about the burner tile. A barrier member in proximity to the furnace floor forms a flue gas tunnel to collect internal flue gas, and the collected flue gas is passed to the vicinity of the secondary fuel nozzles where a portion is aspirated into the combustion zone by fluid driven eductors through access openings in the burner tile.

Previously known processes and apparatuses are generally capable of reducing $NO_x$ emission levels, but numerous disadvantages or limitations limit the applications for such processes and apparatuses, including the prior art burner assemblies discusses above. Such processes and apparatuses variously fail to provide full emission control; incur flame instability; produce additional emission constituents that are themselves recognized as undesirable; require additional costs, including initial capital outlay and ongoing operating expenses; and many present unacceptable liability exposure.

Processes and apparatuses capable of producing acceptable $NO_x$ and CO emission levels and which overcome the numerous disadvantages and limitations of previously known processes and apparatuses are constantly being sought. It is to such that the present invention is directed.

SUMMARY OF THE INVENTION

The present invention provides a burner assembly and process which achieve very low $NO_x$ and carbon monoxide emissions in a flue gas effluent resulting from combustion of industrial fuels, and provide flame stability over a full operating range under wide variations of fuel composition.

A self-metering burner assembly is provided having a burner member with an ignition zone and a mixing zone defined in a throat bore extending therethrough. A pilot ignites a minor portion of a fuel gas to start an ignition flame in the ignition zone which thereafter is maintained continuously of itself. A plurality of meter channels extend through the burner member to communicate with at least one mixing zone to direct an admixture of the remainder of the fuel and diluent to the mixing zone for turbulent mixing with air flowing through the throat bore to be ignited by the ignition flame. The total combustion air passes through the ignition zone and the mixing zone of the burner member, and a flame stabling device is provided for flame stability of the ignition flame.

The present invention substantially inhibits the formation of $NO_x$ and carbon monoxide while producing a stable flame over the entire operating range of the burner assembly for wide variations in fuel make-up. The total $NO_x$ emissions can be controlled below about 8 ppmvd, and the total carbon monoxide content is controlled below about 10 ppmvd.

Further, the burner assembly can assume various constructional configurations which affords the capability of shaping the combustion flame to meet various industrial combustion applications.

Accordingly, an object of the present invention is to provide an improved multiple purpose process and burner assembly for inhibiting the formation of deleterious pollutants in the combustion of a fuel.

Another object of the present invention, while achieving the above stated object, is to provide an improved process and burner assembly for achieving flame stability over a full operating range while substantially inhibiting $NO_x$ and carbon monoxide formation in the combustion of a fuel gas.

One other object of the present invention, while achieving the above stated objects, is to provide a self-metering and self-controlling burner assembly.

Another object of the present invention, while achieving the above stated objects, is to provide improved flame stability and substantial inhibition of $NO_x$ and carbon monoxide formation when combusting fuels of widely varying compositions.

An important object of the present invention, while achieving the above stated objects, is to provide an improved process and burner assembly capable of achieving flame stability while shaping the combustion flame, as required, to serve a wide variety of industrial combustion applications, while also inhibiting $NO_x$ and CO formation thereby.

Yet another object of the present invention, while achieving the above stated objects, is to provide a process and burner assembly having improved flame stability and achieving substantial inhibition of $NO_x$ and carbon monoxide generation while minimizing manufacturing, operating and maintenance costs.

Other objects, features and advantages of the present invention will become clear from the following description when read in conjunction with the drawings and appended claims.

BRIEF DESCRIPTION OF THE DRAWINGS

FIG. 9 is a semi-detailed, partial cutaway, partial diagrammatical representation, in elevation, of the burner assembly of FIG. 6 illustrating an ignition flame and a flame envelope resulting from ignition of primary and secondary fuel/diluent streams intermingling with the ignition flame and each other during operation of the burner assembly.

DESCRIPTION

Figure 1:
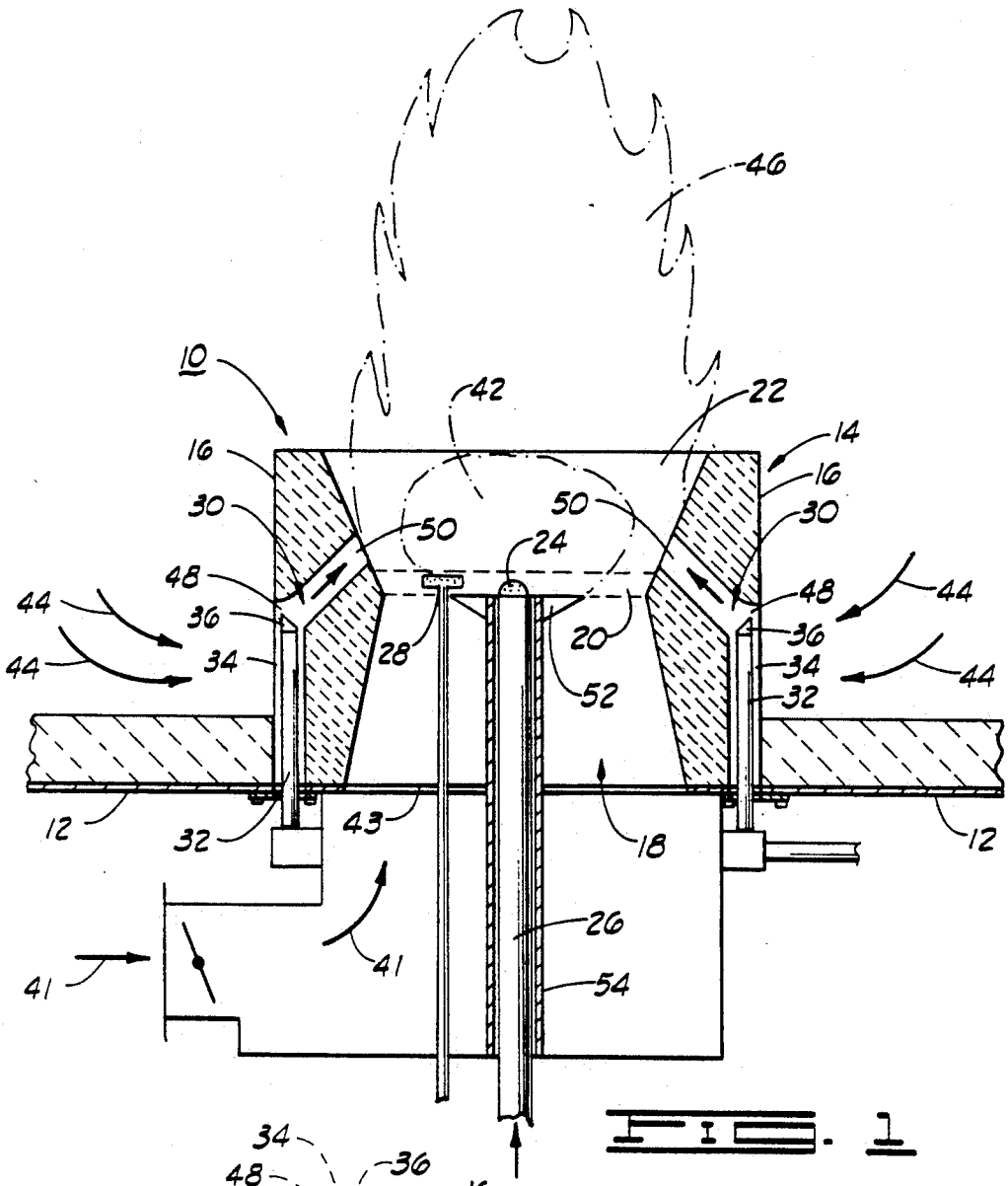
FIG. 1 is a semi-detailed, partial cutaway representation, in elevation, of a self-metering burner assembly constructed in accordance with the present invention.

Prior to describing the burner assembly of the present invention, a brief discussion of the formation of the deleterious constituents of $NO_x$ and CO as a result of the combustion of fuels will be provided to enable one to appreciate the numerous advantages and benefits afforded by the present invention.

$NO_x$ production can be reduced by lowering the flame temperature and delaying combustion, as mentioned above. In the past, when inert gas has been used as a diluent to lower flame temperature, the stability of the flame and high CO production (above 200 ppmvd) have become problems. $NO_x$ emission could only be reduced to the 20–30 ppmvd range under the best of circumstances. Attempts to go below this range of $NO_x$ emission require inert gas rates that cause the air/fuel-/inert gas mixture to be:

(a) outside the flammability limits of the mixture, causing flame out; or (b) chilled to the point that high CO production results. Both of these are undesirable and have limited the effective use of an inert gas diluent to reduce $NO_x$ and CO production.

High CO production and poor flame stability are also limiting factors for reducing $NO_x$ in the operation of staged fuel burners. It is known that $NO_x$ is reduced as the secondary fuel nozzles are disposed farther and farther away from the primary fuel nozzle. But, a point is reached where the primary fuel firing rate must be increased to provide stable combustion of the fuel from the secondary fuel nozzles. As the primary fuel is increased in order to maintain flame stability, the $NO_x$ goes up. Furthermore, CO formation increases as the secondary fuel nozzles are moved away from the primary fuel. Therefore, there is an optimum distance that the secondary fuel nozzles should be from the primary fuel nozzles in order to keep CO production below about 200 ppmvd, primary fuel between 25–30 percent of the total fuel combusted, and $NO_x$ in the 40–70 ppmvd range. This optimum distance will change for different fuel compositions, and staged fuel burners can not make adjustments for such once this distance is fixed.

In addition, staged fuel burners have not had a way of controlling the mixing of the combustion air, fuel, and recirculated flue gas in the secondary zone. These gases have to find each other in the firebox of the furnace, so random mixing (or the lack of mixing) causes either high $NO_x$ production, if the mixing is too rapid, or high CO production, if the mixing is too slow.

Staged air burners suffer from the same limitation as that of staged fuel burners in reducing $NO_x$. High CO production limits the $NO_x$ reducing capabilities as CO formation is much higher than in staged fuel burners. Mixing of secondary or tertiary air with the fuel and recirculated flue gas is uncontrolled and is the result of random mixing in the firebox.

The burner assembly of the present invention is similar in some ways to a staged fuel burner, but much different in construction and concept. This will become clear with the description provided herein, and further discussions will be provided as such description progresses.

In the discussion and description provided herein, air is mentioned as the source of oxygen used in the combustion process, but the present invention is not limited to the use of combustion air. It should be noted that the present invention can achieve the beneficial results when utilizing other oxygen bearing gases. Examples of such oxygen bearing gases are turbine exhaust gas, enriched air, and other gases which contain any oxygen components suitable for the combustion process such as $NO_2$, $N_2O_4$, and the like.

In the description of the drawings, like numerals will be used to designate like components. Also, numerous details of the structures, such as valving, piping, controls, insulation, etc., have been omitted throughout the drawings in order to present the disclosure more clearly as such details will be known by persons skilled in the combustion art.

FIGS. 1-3

Figure 2:
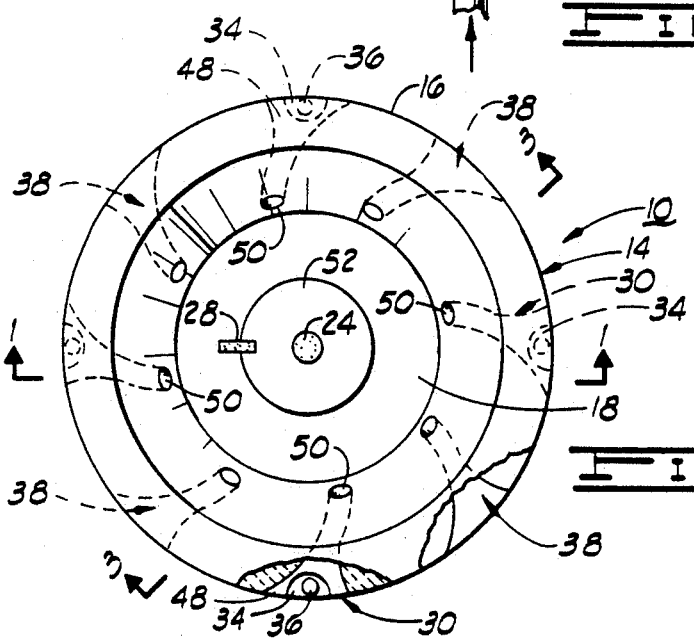
FIG. 2 is a top plan view of the burner assembly of FIG. 1 showing the fuel ports in the burner member. Also shown in FIG. 2 are optional flue gas ports. The view shown in FIG. 1 is taken at 1—1 in FIG. 2.
Figure 3:
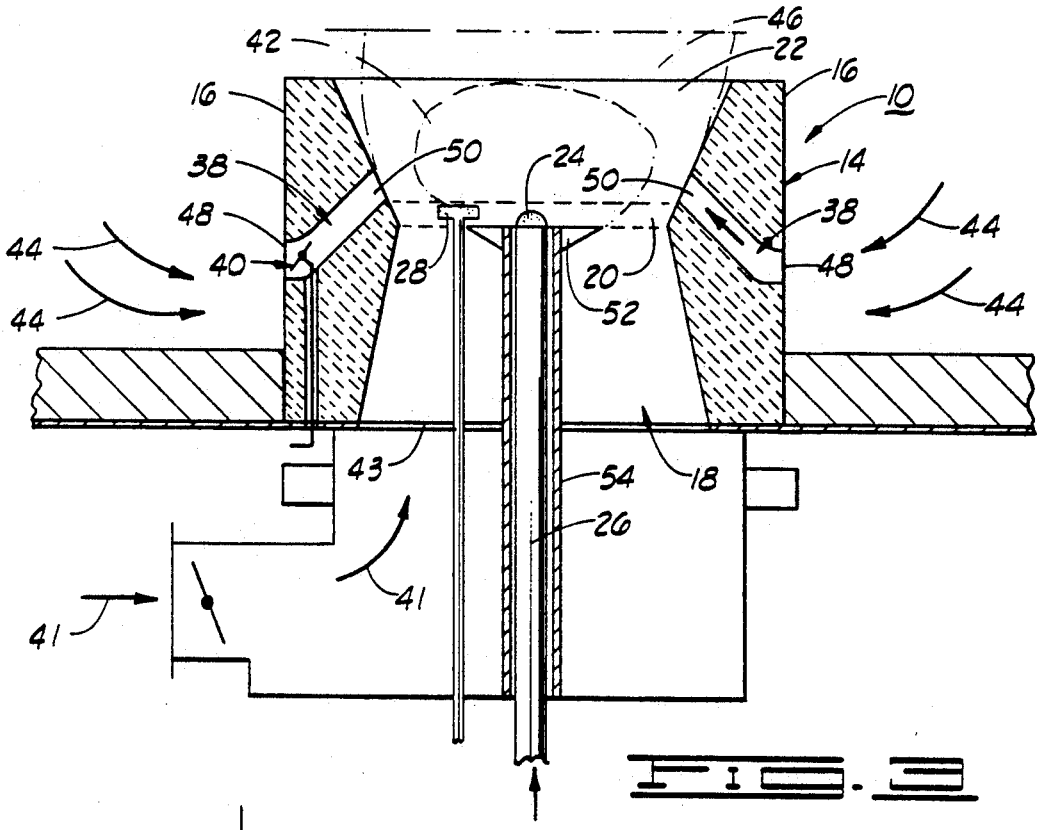
FIG. 3 is a semi-detailed, partial cutaway representation, in elevation, of the burner assembly of FIG. 1 having the optional flue gas ports shown in FIG. 2. The view shown in FIG. 3 is taken at 3—3 in FIG. 2.

Referring now to the drawings, and more particularly to FIGS. 1 through 3, shown therein is a self-metering, self-controlling burner assembly 10 of the present invention. The design and operation of the burner assembly 10 substantially inhibits the formation of $NO_x$ and carbon monoxide during combustion of a fuel, while at the same time, improved flame stability is achieved.

The burner assembly 10, supported on a floor 12 of a furnace (not shown), includes a burner member 14 having a continuous sidewall 16 forming a burner throat 18; the burner throat 18, sometimes herein referred to as a burner throat bore, extends through the burner member 14. The burner throat 18 is characterized as having an ignition zone 20 and a mixing zone 22 that are located as indicated. Further, the burner throat 18 has a converging cross section from a lower end of the burner member 14 to the ignition zone 20, and it has a diverging cross section from the ignition zone 20 through the mixing zone 22 to the upper end thereof substantially as shown. However, the burner throat 18 is not to be considered limited to such a configuration.

An ignition nozzle 24, supported on an upper end of a fuel riser or line 26, extends into the burner throat 18 of the burner member 14 so that the ignition nozzle 24 is positioned within the ignition zone 20 of the burner throat 18; and a conventional pilot 28 is disposed adjacent the ignition nozzle 24 for initially igniting fuel discharged from the ignition nozzle 24. A plurality of meter channels 30 extend through the sidewall 16 of the burner member 14 and communicate with the mixing zone 22 of the burner throat 18. A plurality of fuel risers 32 are peripherally disposed in grooves 34 formed in the sidewall 16 of the burner member 14. Supported on the upper end of each of the fuel risers 32 is a fuel dispensing nozzle 36. One of the fuel dispensing nozzles 36 is disposed within each of the meter channels 30 substantially as shown. Additional meter channels 38 (FIGS. 2 and 3). not associated with the fuel dispensing nozzles 36 may be spatially disposed in the sidewall 16. A damper 40 may be disposed within some or all of the meter channels 38 to control the flow of recirculated flue gas therethrough. The meter channels 38 and their function will be described in more detail hereinafter.

The term diluent, recirculated flue gas and combustion gas are sometimes used interchangeably throughout the disclosure. However, as will be fully set forth hereinafter, diluents employed to produce the fuel/diluent admixture are not limited to recirculated flue gas.

In the burner assembly 10, a major portion of the fuel (i.e. generally from about 75 to about 98 percent, and more desirably from about 80 to about 96 percent) is dispensed through the fuel dispensing nozzles 36 into the mixing zone 22 in the burner throat 18 via the meter channels 30 as primary fuel, while a lesser or minor portion of the fuel (i.e. generally from about 2 to about 25 percent, and more desirable from about 4 to about 20 percent) is dispensed through the ignition nozzle 24 into the ignition zone 20 of the burner throat 18 as ignition fuel. The amount of ignition fuel required will be an amount which, upon ignition, provides a temperature and a sufficient amount of energy to ignite the primary fuel discharged into the mixing zone 22 via the meter channels 30.

Total combustion air (indicated by arrows 41) is introduced into the burner throat 18 via an inlet port 43 in the floor 12. The total combustion air is the amount of air required to support an ignition flame 42 and combustion of the fuel/diluent stream in the mixing zone 22 of the burner throat 18. Upon ignition of the ignition fuel by the pilot 28, the ignition flame 42 is established, and the pilot 28 may be shut off, unless safety requirements direct otherwise, once this ignition flame is established. Thus, when the fuel/diluent stream is dispensed into the mixing zone 22 via the meter channels 30 the fuel/diluent stream is turbulently and intimately admixed with the combustion air in the mixing zone 22. The resulting fuel diluent/combustion air mixture is ignited by the ignition flame 42 so that combustion of the fuel/diluent-/combustion air mixture is initiated in the mixing zone 22 of the burner throat 18.

The combustion of the fuel/diluent/combustion air mixture produces a hot stream of flue gas components having relatively low density. Cooler heat transfer surface areas in the furnace cool portions of the flue gas components and establish cooler, relatively higher density flue gas. The higher density, cooler gas tends to move vertically downward as the lower density, hotter gas rises vertically upward to be exhausted as flue gas effluent from a stack section (not shown). This circulation of flue gas within the furnace is commonly referred to as "the furnace effect" and is present in any combustion process when cooler heat absorbing surfaces are present in the firebox of the furnace.

The higher density, cooler gas constitutes recirculated flue gas and is generally indicated by the arrows 44. The recirculated flue gas serves largely as a diluent and is drawn into the meter channels 30 for admixture with the fuel streams as fuel is dispensed into the meter channels 30 by the fuel dispensing nozzles 36, and by the aspirating effect created in the burner throat 18 as a result of the hot flue gases expanding and exiting the burner throat 18.

The meter channels 30 admix the recirculated flue gas and the fuel to produce the fuel/diluent streams which are passed to the mixing zone 22 to be mixed with combustion air and contacted by the ignition flame 42 so that initial combustion of the fuel/diluent/air mixture occurs in the mixing zone 22 of the burner throat 18. Further, because of the various static and dynamic design features of the meter channels 30, described more fully below, the meter channels 30 automatically meter the composition of the fuel/diluent stream into the mixing zone 22. That is, the meter channels 30 admix the recirculated flue gas with the fuel to produce fuel/diluent streams which are dispensed and metered into the mixing zone 22 of the burner throat 18 where the fuel/-diluent streams are turbulently and intimately admixed with combustion air and ignited by the ignition flame 42 to produce a flame envelope 46, also discussed further below.

Each of the meter channels 30 is characterized as having a flared inlet end 48 and a outlet port end 50. The flared inlet end 48 enhances the passage of the recycled flue gas into the meter channels 30 so that a proper admixture of flue gas and fuel is obtained. Further, the outlet port ends 50 are positioned (i.e. location and orientation) so that a desired mixing rate of the fuel stream with the combustion air is determined by the swirl angle and the height of the outlet port ends 50 of the meter channels 30 within the mixing zone 22. The term "swirl angle" as used herein is to be understood to be the angle that the center axis of each of the meter channels 30 makes with a line extending from the center of the burner throat 18 to the center of the respected outlet port end 50 of the meter channel 30. A swirl angle can therefore have both a horizontal and a vertical component.

The rate of rotation or swirl of the fuel/diluent stream created in the burner throat 18 is controlled by the swirl angle. Thus, the swirl angle can be an important consideration in determining the rate of mixing of the combustion air and fuel/diluent streams, as well as in the shape of the flame envelope 46; in general, such swirl angle is empirically established for each application of the present invention. The burner member 14 can be provided a lip portion (not shown) located at the upper end of the burner throat 18 to serve as a partial choke thereof, or other such protuberances can be disposed to extend from the burner member 14 in the burner throat 18, the purpose of which being to provide additional turbulence creating mechanisms within the burner throat 18. Such turbulence creating mechanisms are not believed necessary in most applications as sufficient turbulence is created by the swirl angle discharge imparted to the fuel/diluent streams by the meter channels 30.

The static design features of the meter channels 30 are related to the number, size, shape, location and swirl angle of the meter channels 30. For example, the diluent rate can be increased for a given design by increasing the number of meter channels 30 that induce diluent into the mixing zone 22 by the aspirating effect of the hot gases expanding and leaving the burner throat 18 of the burner assembly 10. The size of the meter channels 30 can be increased in cross sectional area, and the shape of the meter channels 30 can be flared at both the inlet and port ends 48, 50 to improve the efficiency of the meter channels 30. Further, the location and swirl angle of the meter channels 30 within the sidewall 16 of the burner throat 18 can be varied to change the rate of mixing of the fuel/diluent stream with the combustion air stream in the mixing zone 22 of the burner throat 18.

The dynamic design features of the meter channels 30 that monitor the amount of diluent flowing into the mixing zone 22 of the burner throat 18 through the meter channels 30 is based on changing fuel pressure and the aspirating effect due to changing burner heat release.

In many applications, the amount of diluent required to achieve the desired $NO_x$ will be introduced by the meter channels 30 associated with the fuel dispensing nozzles 36. In some cases, however, more diluent may be desirable. Meter channels, such as the meter channels 38 which do not have associated fuel nozzles, can be provided so that additional diluent can be drawn into the mixing zone 22. Dampers 40 may be used to control the diluent flow introduced into the mixing zone 22 by the meter channels 38.

To enhance flame stability the burner assembly 10 is provided with a flame holder 52 which is supported by a guide tube 54 disposed about the fuel riser 26 so that the flame holder 52 is positioned substantially adjacent the ignition nozzle 24. As used herein, the term "flame holder" is used to denote any structure that helps stabilize the ignition flame. The structure of stabilization may be mechanical or physical. Examples of mechanical structures are cones or diffusers which block some of the air stream and create a low pressure zone near the ignition nozzle 24. Examples of a physical structure are a fuel spray angle, velocity or premix fuel that create a low pressure or ignition zone near the ignition nozzle 24.

Operation of Burner Assembly 10

In the operation of the burner assembly 10 the fuel/-diluent streams are introduced into the mixing zone 22 of the burner throat 18 so as to achieve the stability (as that term is defined hereinbelow) of the fuel/diluent/air mixture such that combustion of the fuel/diluent/air mixture is initiated within the mixing zone 22.

It is desirable to achieve stable combustion in the burner assembly 10 with the maximum diluent possible without producing flame instability or high levels of CO. The amount of flue gas or diluent which can be admixed with the fuel will be dependent upon: the temperature of the fuel; the temperature of the diluent; the temperature of the air; the composition of the fuel and diluent; the oxygen content in the mixing zone 22 of the burner throat 18; and the rate of mixing of the fuel/diluent streams with combustion air in the mixing zone 22 of the burner throat 18.

The burner assembly 10 can be operated in two different modes. The first mode of operation manifolds the ignition nozzle 24 with the fuel dispensing nozzles 36 so that both are supplied from a common source of fuel. As fuel demand increases, the heat release from the ignition nozzle 24 and fuel dispensing nozzles 36 increases. Alternatively, as fuel demand increases, the heat release from the ignition nozzle 24 may be fixed and the heat release from the fuel dispensing nozzles 36 may be increased. The increase of fuel gas leaving the dispensing nozzles 36 increases the flow of diluent into the meter channels 30 The aspirating effect is increased as heat release is increased. Thus, the rate of diluent admixed with the primary fuel will increase to limit the $NO_x$ formation as heat release increases.

In the second mode of operation of the burner assembly 10, separate sources of fuel are employed for the ignition fuel and for the primary fuel. That is, the ignition nozzle 24 and the fuel dispensing nozzles 36 are not manifolded. With varying composition fuels, this mode of operation can achieve the lowest $NO_x$ levels because the ignition fuel can be natural gas or the like, and the burner assembly 10 can be base loaded (held constant) at the minimum release required to ignite the primary fuel in the mixing zone 22. The primary fuel to the meter channels 30 is then controlled by heat demand. As heat demand goes up, the fuel pressure increases as does the rate of the primary fuel to the meter channels 30, which induces more diluent for delivery to the mixing zone 22 in the burner throat 18, and the higher heat release also increases the diluent aspirating effect from the burner throat 18.

The self-metering effects of the meter channels 30 are further illustrated by considering a typical refinery fuel gas. This fuel gas can vary from 100 percent natural gas, to 75 percent $H_2$ and 25 percent $C_1$ through $C_6$, and higher. Experience with the burner assembly 10 has shown that this wide variance in gas composition and gas heating value does not adversely affect its operation. As hydrogen content in a refinery fuel gas goes up the adiabatic flame temperature goes up and therefore $NO_x$ formation usually increases. However, when utilizing the burner assembly 10 of the present invention, as the hydrogen content in the fuel goes up, so does the fuel pressure for the equivalent natural gas heat release. This effect is self metering to control $NO_x$ at desired levels because, as the fuel pressure increases, the amount of diluent entering the mixing zone 22 in the burner throat 18, via the meter channels 30, also increases.

The amount of flue gas or diluent admixed with the fuel to produce the fuel/diluent streams is controlled by the meter channels 30. That is, the rate and the amount of diluent admixed with the fuel will be dependent upon the number, size and shape of the meter channels 30, and the fuel pressure, spray angle, and density of the fuel. The mixing rate of the fuel stream with combustion air in the mixing zone 22 of the burner throat 18 is further influenced by the swirl angle and location of the meter channels 30.

While desirable results have been obtained when employing recirculated flue gas as the diluent in the formation of the fuel/diluent streams for combustion in the burner assembly 10, it should be understood that any suitable diluent compatible with the fuel under the combustion conditions in the burner assembly 10 can be employed, provided such diluent: (a) has limited oxygenate value; (b) has a low adiabatic flame temperature (as compared to conventional fuel gases); (c) is capable of functioning as a heat sink; and (d) can be delivered to the inlet end 48 of the meter channels 30. Examples of diluents, in addition to internally recirculated flue gas, which satisfy these criteria are: externally recirculated flue gas; nitrogen; steam; carbon dioxide; and the like. Coker off gas or other pre-inerted, low adiabatic flame temperature gases can also be used as diluents, but as discussed further below, such gases can themselves at times be used as fuel/diluent streams. Because diluents are well known in the combustion art, further description of such diluents is not believed necessary in order for one skilled in the art of burners.

The burner assembly 10 provides for metered and controlled turbulent and intimate mixing of the fuel/diluent streams with the combustion air in the mixing zone 22 of the burner throat 18. Because such mixing of the fuel, diluent and combustion air occurs within the mixing zone 22, only small heat releases are required from the ignition fuel in order to commence stable combustion of the fuel/diluent/combustion air mixture in the mixing zone 22. Stable flames have been produced utilizing the burner assembly 10 when the energy output of the ignition flame 42 is less than about 5 percent of the total burner heat release without formation of undesirable amounts of carbon monoxide. Further, because of the dilution of the fuel with the diluent in the meter channel 30, and the turbulent and intimate mixing of the fuel/diluent stream with combustion air in the mixing zone 22, formation of $NO_x$ in the combustion of the fuel/diluent/combustion air mixture is substantially inhibited.

The improved levels of $NO_x$ and carbon monoxide formation from the combustion of a fuel in the burner assembly 10 is achieved because it provides:

(a) metering of precise amounts of fuel and diluent into the burner assembly 10;

(b) precise formation and delivery of a fuel/diluent stream consisting of blended fuel and diluent;

(c) turbulent and intimate mixing of the fuel/diluent stream with combustion air in the mixing zone of the burner assembly 10 to form a fuel/diluent/combustion air mixture;

(d) ignition of the fuel/diluent/combustion air mixture in the mixing zone 22; and (e) stable combustion of variable fuel gas mixtures without modification of the burner assembly 10 or external instrumentation and controls.

The amount of diluent that can be mixed with primary fuel to produce fuel/diluent streams with the required flame stability depends on several variables, such as: fuel gas composition; fuel temperature; air temperature; diluent composition; diluent temperature; and the amount of combustion air present in the mixing zone 22 of the burner throat 18. The diluent can be delivered to the mixing zone 22 by the meter channels 30 in one or more of the following ways:

(a) Aspirating effect of the reduced density of the hot gases leaving the mixing zone 22 induces flow of the diluent.

(b) Fuel gas is blended with the diluent gas and the mixture propelled by fuel gas the meter channels 30.

(c) Other pressurized fluids (e.g. steam $CO_2$, $N_2$, etc.) blended with the diluent and the mixture is aspirated into the mixing zone 22.

(d) The diluent is driven into the meter channel 30.

The proper rate of diluent delivery to the mixing zone 22 is a function of the meter channels 30, and when appropriate, the meter channels 38. That is, the amount of diluent admixed with the fuel will be controlled by the number, size, shape, location and swirl angle of the mixing channels.

The amount of diluent is also a function of the shape and size of fuel dispensing apertures in the primary or secondary fuel nozzles. The type of fuel and the operating conditions of the burner determine the design and quantity of meter channels 30, 38 for the burner assembly 10.

The simplest version of the burner assembly 10 involves ignition fuel, primary fuel, the meter channels 30, and the burner member 14 having the ignition zone 20 and the mixing zone 22, with all of the combustion air passing through the burner throat 18. As a result, very stable primary fuel flames have been produced from ignition fuel streams that have an energy output of greater than about 2 percent but less than 20 percent of the total burner heat release; and even less than about 2 percent ignition fuel has been demonstrated in some instances.

Stability of the burner assembly 10 is achieved because the ignition flame 42 produces a temperature and sufficient energy to maintain stable combustion of the fuel/diluent/combustion air mixture. Further, CO formation is maintained at a very low level (less than about 10 ppmvd) because all of the combustion air passes through the mixing zone 22, and the fuel/diluent streams and combustion air do not have to randomly seek each other, but rather are turbulently and intimately admixed in the mixing zone 22.

The meter channels 30 and 38 have been illustrated as individual elements. However, it should be understood that the meter channels 30 and 38 can be defined by an annulus or the like which extends through the sidewall 16 of the burner member 14.

Figure 4:
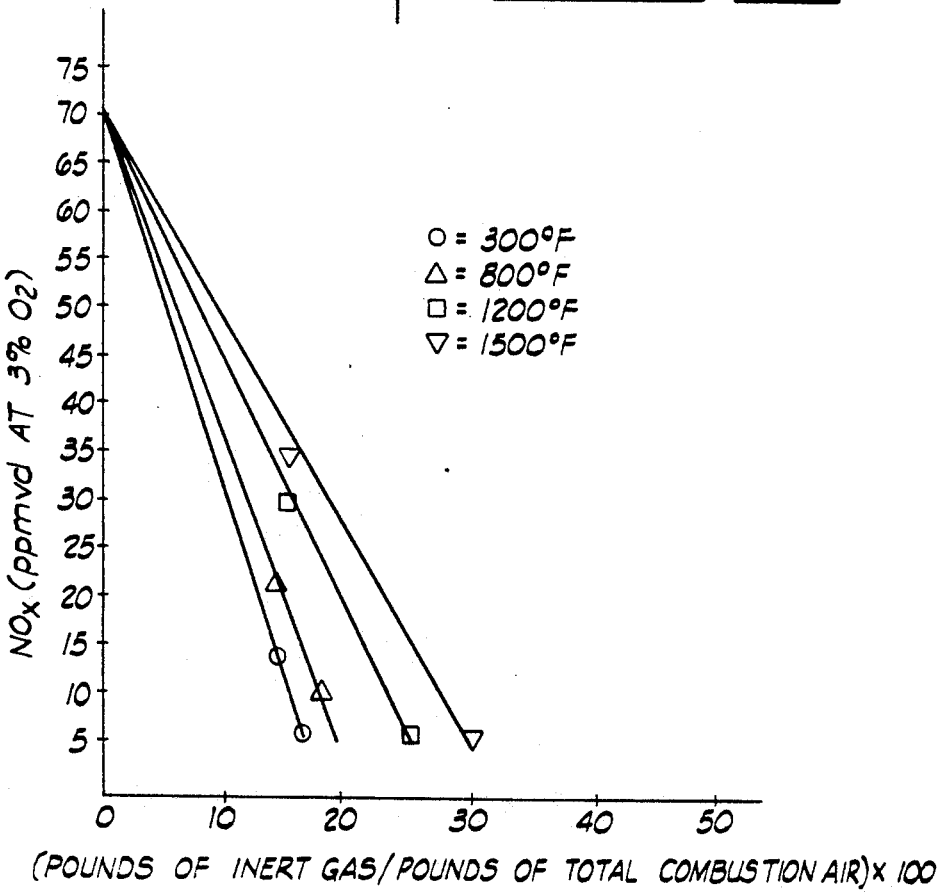
FIG. 4 is a graphic illustration of $NO_x$ formation versus percentage of inert gas (diluent) in the combustion air at various temperatures of the inert gas.
Figure 5:
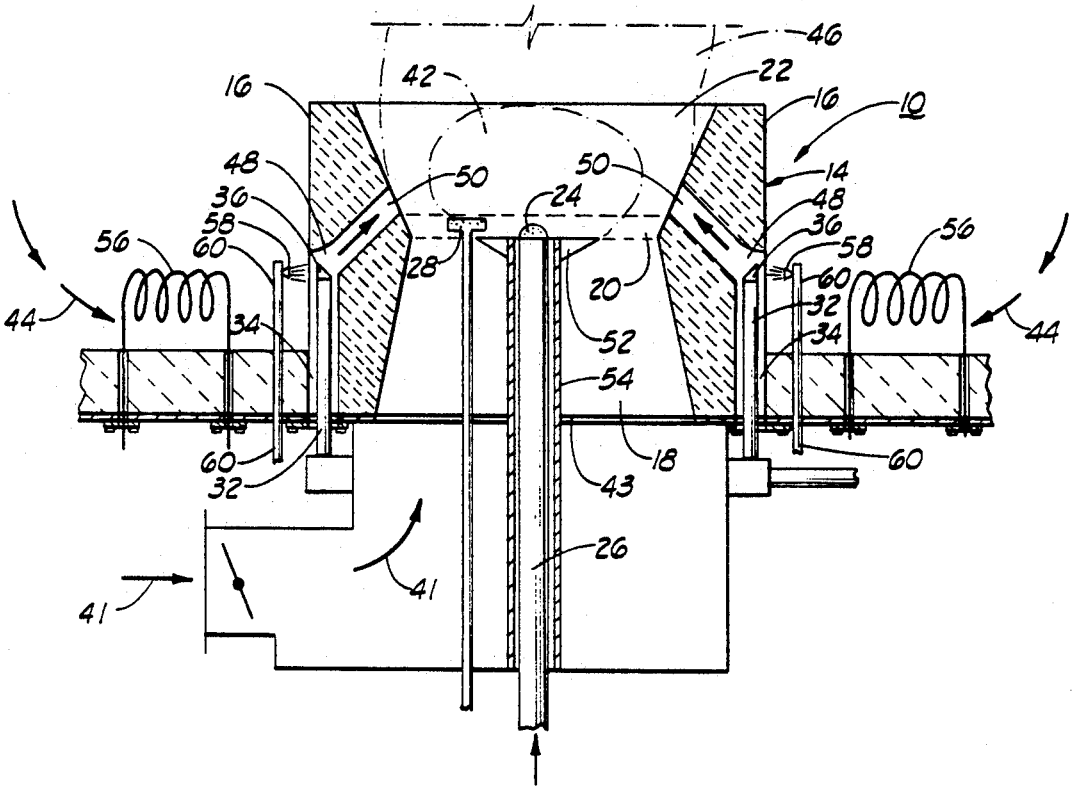
FIG. 5 is a semi-detailed, partial cutaway representation of the burner assembly of FIG. 1 having optional cooling coils and spray nozzles for cooling internally recirculated flue gas prior to admixture with fuel.

FIGS. 4 and 5

FIG. 4 is a graph showing the effect of diluent temperature on the formation of $NO_x$. As the temperature of the diluent is reduced, the amount of diluent required to be mixed with the primary fuel to achieve a desired level of $NO_x$ is also less. If internal flue gas is used as the diluent, it is typically at a fixed temperature. In order to inhibit the formation of $NO_x$ utilizing hot internal flue gas diluent, the diluent effect can be increased by cooling the flue gas diluent.

FIG. 5 illustrates the burner assembly 10 modified to achieve cooling of the recirculated flue gas when such is employed as the diluent. A cooling coil 56 is supported as shown within the furnace for circulation of a cooling fluid therethrough. Alternatively, or in addition thereto, spray nozzles 58 are supported by risers 60 and are disposed in close proximity to the meter channels 30. The cooling coils 56 or fluid discharged from the spray nozzles 58 cool the recirculated flue gas prior to its entering the meter channel 30 for admixture with the primary fuel. Cooling of the diluent provides two desired effects, as follows:

a. the meter channel 30 can deliver more lbs/hr of recirculated flue gas as the flue gas is cooled and its density increases; and b. the cooler recirculated flue gas is more effective as a heat sink.

These positive effects are confirmed by the graphs of FIG. 4 which illustrate the reduction in $NO_x$ production associated with increased diluent rates and reduced diluent temperatures.

Figure 6:
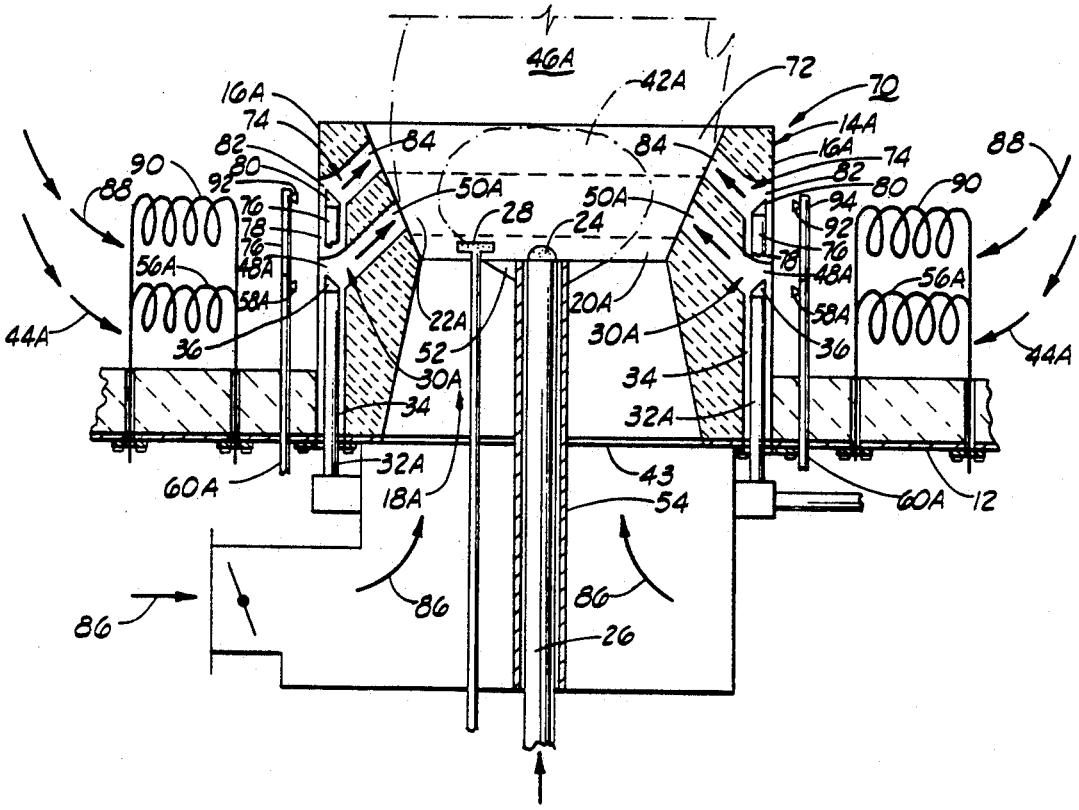
FIG. 6 is a semi-detailed, partial cutaway, partial diagrammatical representation, in elevation, of another embodiment of a self-metering burner assembly constructed in accordance with the present invention.
Figure 7:
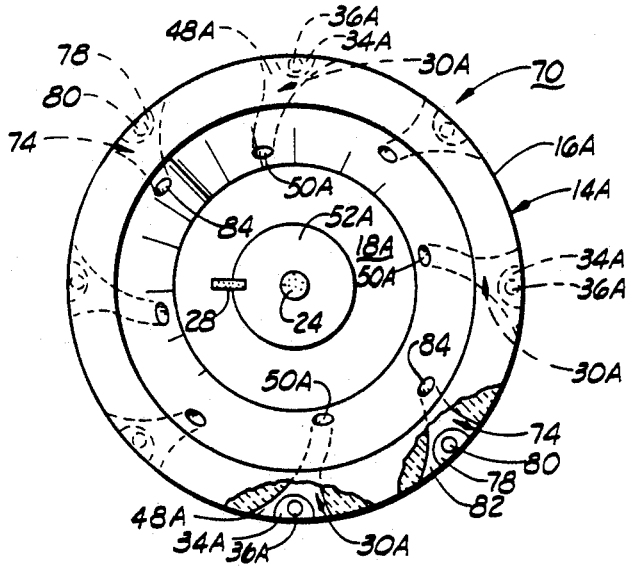
FIG. 7 is a top plan view of the burner assembly of FIG. 6.

FIGS. 6 and 7

Referring now to FIGS. 6 and 7, another burner assembly 70 constructed in accordance with the present invention is illustrated. The burner assembly 70 is substantially identical in construction to the burner assembly 10, with the exceptions that will be hereinafter noted, so like numerals will designate like components thereof.

The burner assembly 70 is supported on the floor 12 of a furnace (not shown) and includes a burner member 14A having a continuous sidewall 16A which defines a burner throat or throat bore 18A. The burner throat 18A defines an ignition zone 20A, a first mixing zone 22A, and a second mixing zone 72 substantially as designated. Further, the burner throat 18A has a converging cross section from a lower end to the ignition zone 20A and a diverging cross section from the ignition zone 20A through the mixing zone 22A to the upper end thereof.

Ignition nozzle 24, which is supported on an upper end of the fuel riser 26, extends into the burner throat 18A so that the ignition nozzle 24 is positioned within the ignition zone 20A of the burner throat 18A; and the pilot 28 is disposed adjacent the ignition nozzle 24A for initiating ignition of the fuel discharged from the ignition nozzle 24. A plurality of first meter channels 30A extend through the sidewall 16A of the burner member 14A so as to communicate with the first mixing zone 22A in the burner throat 18A; and a plurality of second meter channels 74 extend through the sidewall 16A so as to communicate with the second mixing zone 72 in the burner throat 18A. The second meter channels 74 are spatially and radially displaced relative to the first meter channels 30A (FIG. 7), and as desired, the angular disposition, orientation and shape of the first and second meter channels 30A and 74 can be varied in order to enhance operation of the burner assembly 70. It should be remembered that FIG. 6 is a semi-detailed, diagrammatical representation, and due to the limitations of a two dimensional drawing, the second meter channels 74 are shown immediately above the meter channels 30A. FIG. 7 depicts the meter channels 74 radially displaced from the meter channels 30A as is preferrable.

The fuel risers 32 are peripherally disposed in grooves 34A formed in the sidewall 16A of the burner member 14A. Supported on the upper end of each of the fuel risers 32 is one of the fuel dispensing nozzles 36. One of the fuel dispensing nozzles 36 is disposed within each of the meter channels 30A substantially as shown.

A plurality of fuel risers or lines 76 are peripherally disposed in grooves 78 formed in the sidewall 16A of the burner member 14A. Supported on the upper end of each of the fuel risers 76 is a fuel dispensing nozzle 80. One of the fuel dispensing nozzles 80 is disposed within each of the second meter channels 74 substantially as shown.

The first meter channels 30A are each provided with a flared inlet end 48A and an outlet port end 50A. Similarly, the second meter channels 74 are each provided with a flared inlet end 82 and an outlet port 84. The flared inlet ends 48A, 82 of the first and second meter channels 30A, 74 enhance the passage of recirculated flue gas into the first and second meter channels 30A, 74 so that a proper admixture of the flue gas with the primary and secondary fuel streams is obtained. The outlet port ends 50A, 84 of the first and second meter channels 30A, 74 are positioned (i.e. located and oriented) within the sidewall 16A of the burner member 14A such that the swirl angle and position of the outlet port ends 50A, 84 communicate with the first and second mixing zones 22A, 72, respectively, of the burner throat 18A and cooperate to provide the desired mixing rate of the fuel/diluent streams with the combustion air in the first and second mixing zones 22A and 72.

The primary and secondary fuel streams (also referred to at times as the first fuel stream and the second fuel stream and which together contain from about 75 to about 98 percent of the total fuel burned) are dispensed from the fuel dispensing nozzles 36 and 80 to the first and second mixing zones 22A and 72 in the burner throat 18A via the first and second meter channels 30A, 74, while ignition fuel (which constitutes from about 2 to about 25 percent of the total fuel burned) is dispensed through the ignition nozzle 24 into the ignition zone 20A of the burner throat 18A.

All of the combustion air (indicated by the arrows 86) is introduced into the burner throat 18A via the inlet port 43 in the floor 12. The total combustion air is the amount of air required to support the ignition flame 42A and combustion of the primary and secondary fuel/diluent streams in the first and second mixing zones 22A, 72 to produce the flame envelope 46A. That is, upon initial ignition of the ignition fuel by the pilot 28 the ignition flame 42A is established. The pilot 28 may be shut off once the ignition flame 42A is established. Thus, when the primary and secondary fuel streams are dispensed into the first and second mixing zones 22A, 72, metered and controlled, turbulent and intimate mixing of the primary and secondary fuel/diluent/combustion air occurs in the first and second mixing zones 22A, 72. Therefore, combustion of the primary fuel is commenced within the first mixing zone 22A upon ignition by the ignition flame 42A, and combustion of the secondary fuel stream is commenced within the second mixing zone 72 as a result of the temperature and thermal energy provided by the flame of the primary fuel. Thus, combustion of the primary and secondary fuel streams (diluted as admixed with accompanying diluent gas) is started in the first and second mixing zones 22A and 72 of the burner throat 18A and not in the cavity of the furnace downstream to the burner assembly 70.

The ignition fuel injected into the ignition zone 20A of the burner throat 18A should be sufficient in amount such that, upon initial ignition by the pilot 28, will sustain the ignition flame 42A at an adequate temperature and thermal energy level to ignite the primary fuel/-diluent/combustion air mixture in the first mixing zone 22A; ignition of the primary fuel/diluent/combustion air mixture in the mixing zone 22A then produces an adequate temperature and thermal energy level to ignite the secondary fuel/diluent/combustion air mixture in the second mixing zone 72. This effect makes it possible to have multiple mixing zones in which flames commenced therein "build" upon each other. That is, ignition of the ignition fuel and the fuel/diluent streams introduced into each succeeding mixing zone provides the temperature and thermal energy required to ignite and stabilize the burning of fuel streams in the downstream mixing zone. The diluent rates can be increased while maintaining stable combustion as this building process continues through multiple zones.

This "building effect" not only inhibits $NO_x$ production, it also lowers the peak flame temperature, which provides the additional benefits of a reduction in peak flux rate and a more uniform flux rate (i.e. peak temperature shaving). $NO_x$ production is also minimized by the uniformly lower temperature associated with the increased diluent rates achievable with multiple mixing zones, and importantly, the CO production is minimized.

The combustion of the primary and secondary fuel/-diluent streams produces a hot stream of flue gas components with relatively low density. Due to furnace effects, cooler recirculated flue gas of higher density is achieved, and such recirculated flue gas is indicated generally by the arrows 44A and 88. The recirculated flue gas 44A is drawn into the first meter channels 30A for admixture with primary fuel as the primary fuel is dispensed into the meter channels 30A from the fuel dispensing nozzles 36, and additionally the recirculated flue gas is drawn through the first meter channels 30A as a result of the aspirating effect created in the burner throat 18A due to the hot gases expanding upon exiting the burner throat 18A. Similarly the recirculated flue gas 88 is drawn into the second meter channels 74 for admixture with the secondary fuel as the secondary fuel is dispensed into the second meter channels 74 from the fuel dispensing nozzles 80, and also by the aspirating effect achieved in the burner throat 18A due to the hot upon exiting the burner throat 18A.

The first meter channels 30A admix a portion of the recirculated flue gas and the primary fuel to produce a first or primary fuel/flue gas stream (sometimes herein referred to as the first fuel/diluent stream), and the second meter channels 74 admix a portion of the recirculated flue gas and the secondary fuel to produce a second or secondary fuel/flue gas stream (sometimes herein referred to as the second fuel/diluent stream). Further, because of the various static and dynamic design features of the first and second meter channels 30A and 74, the first and second meter channels 30A, 74 meter the primary and secondary fuel/flue gas streams into the first and second mixing zones 22A, 72, respectively, of the burner throat 18A for ignition as above described. Thus, turbulent and intimate mixing of the primary and secondary fuel/flue gas streams with combustion air occurs within the first and second mixing zones 22A, 72 of the burner throat 18A; and ignition of the resulting primary and secondary fuel/flue gas/combustion air mixtures occur within the first and second mixing zones 22A, 72 of the burner throat 18A.

While the first and second meter channels 30A, 74 of the burner assembly 70 are illustrated with the flared inlet ends 48A 82 and cylindrically shaped outlet port ends 50A, 84 respectively, it should be understood that the configuration of the inlet and outlet ends of the first and second meter channels 30A and 74 can vary and will be dependent upon the design and operation of the burner assembly 70. Further, while the meter channels 30A and 74 have been illustrated as individual elements, it should be understood that the meter channels 30A and 74 can each be defined by an annulus or the like extending through the burner member 14A to communicate with the mixing zones 22A, 72, and that angular orientation of the fuel dispensing nozzles 36, 80 can be utilized to effect the desired swirl angle imparted to the fuel/diluent streams.

Flame stability of the burner assembly 70 can further be enhanced by providing the flame holder 52 supported by the guide tube 54 disposed about the fuel riser 26 so that the flame holder 52 is positioned substantially adjacent the ignition nozzle 24.

As previously discussed, it may be desirable to cool the recirculated flue gas when employing same as a diluent. In such instances, the burner assembly 70 is provided with first cooling coils 56A and second cooling coils 90 supported within the furnace for circulation therethrough of an appropriate cooling fluid. Alternately, or in addition thereto, first and second spray nozzles 58A, 92 are supported by first and second risers 60A, 94 and the first and second spray nozzles 58A, 92 are associated with the first and second meter channels 30A, 74, respectively. The first and second cooling coils 56A, 90, or fluid discharged from the first and second spray nozzles 58A, 92, cool the recirculated flue gas prior to its entrance into the first and second meter channels 30A, 74 for admixture with the primary and secondary fuel streams.

As previously set forth, cooling of the diluent increases the density of the diluent so that more diluent can be delivered into the first and second meter channels 30A, 74 for admixture with the primary and secondary fuel streams. In addition, the cooler recirculated flue gas is more effective as a heat sink.

Operation of the Burner Assembly 70

The design of the burner assembly 70 provides substantial inhibition of the formation of $NO_x$ during combustion of a fuel, while at the same time, it provides substantial limitation of carbon monoxide formation.

Further, the burner assembly 70 operates with excellent flame stability.

The burner assembly 70 can be operated in optional modes, as follows. In the first mode of operation, the ignition nozzle 24 is manifolded with the fuel dispensing nozzles 36, 80 so that the same fuel source services both. As fuel demand increases, the heat release from the ignition nozzle 24 and fuel dispensing nozzles 36, 80 increases. Alternatively, as fuel demand increases, the heat release from the ignition nozzle 24 may be fixed, and the heat release from either or both of the fuel dispensing nozzles 36, 80 may be increased. The increase in fuel gas flow from the fuel dispensing nozzles 36, 80 increases the rate of diluent gas drawn into the meter channels 30A and 74. Again, the aspirating effect is increased as heat release is increased in the burner throat 18A. Thus, the rate of diluent (e.g. recirculated flue gas) admixed with the primary and secondary fuel will increase as heat release increases.

In the second mode of operation of the burner assembly 70, separate sources of fuel are employed for the ignition fuel and for the primary and secondary fuel. That is, the ignition nozzle 24 and the fuel dispensing nozzles 36, 80 are not manifolded together. With varying composition fuels, this mode of operation, can achieve the lowest $NO_x$ levels because the ignition fuel can be natural gas or the like, and the burner assembly 70 can be base loaded (held constant) at the minimum release required to ignite the primary and secondary fuels in the burner throat 18A. The rates of primary and secondary fuels are then controlled by heat demand.

As heat demand goes up, the fuel pressure increases, as does the flow of the primary fuel dispensed to the first meter channels 30A and the flow of secondary fuel dispensed to the second meter channel 74. More diluent is delivered thereby to the first and second mixing zones 22A, 72 in the burner throat 18A because of these higher fuel rates and also by the increased aspiration from the burner throat 18A.

For large heat releases (above 15 MM Btu/hr), and to achieve the lowest possible $NO_x$ levels, multiple mixing zones, such as the first and second mixing zones 22A, 72 of the burner assembly 70, are desirable. Further, it should be understood that while the burner assembly 70 has been illustrated as containing two mixing zones (i.e. the first and second mixing zones 22A, 72), additional mixing zones can be provided by increasing the length of the burner throat 18A of the burner assembly 70 as required to accommodate additional tiers or levels of meter channels to communicate fuel/diluent streams to the additional mixing zones.

The burner assembly 70, provided with the single ignition zone 29A and the first and second mixing zones 22A, 72, provides several benefits, among which are:

a. the ignition flame energy can be reduced to less than ten percent of the total burner heat release and b. the total inert gas volume delivered to the burner assembly 70 can be increased while maintaining stable combustion.

These benefits are achieved by creating the required temperature and sufficient thermal energy to maintain stable combustion in each of the first and second mixing zones 22A, 72, starting with the minimum release in the ignition zone 20A and building up through the successive mixing zones 22A, 72. That is, the ignition flame is able to establish and maintain initial combustion in the first mixing zone 22A, and the flame in the first mixing zone 22A is able to establish and maintain initial combustion in the second mixing zone 72. This "building" phenomena can be carried out employing as many mixing zones as required to maintain the $NO_x$ and heat release requirements of the burner assembly 70.

The total quantity of diluent which can be admixed with the fuel is higher in the burner assembly 70 than can be maintained for stable combustion with only one mixing zone. The reason for this is that the temperature and thermal energy supplied by the first mixing zone 22A of the burner assembly 70 maintains the second mixing zone 72 in a stable condition, even though the burner assembly 70 is operating at higher diluent volumes than is possible with a single mixing zone.

The self metering effects of the first and second meter channels 30A, 74 of the burner assembly 70 are further illustrated by considering a typical refinery fuel gas, which can vary from 100 percent natural gas to 75 percent $H_2$ and 25 percent $C_1$ through $C_{6+}$. This wide variance in gas composition and heating value causes control problems in prior art burners. As the hydrogen content of the refinery fuel increases, the adiabatic flame temperature of the fuel increases, and therefore $NO_x$ production usually increases. However, when utilizing the burner assembly 70 as the hydrogen content goes up, so does fuel pressure for the equivalent heat release. This effect results in the first and second meter channels 30A, 74 functioning in a self metering manner, thereby controlling $NO_x$ formation below permissible levels because, as the fuel pressure increases, the amount of diluent drawn into the first and second mixing zones 22A, 72 by the first and second meter channels 30A, 74 increases.

Figure 8:
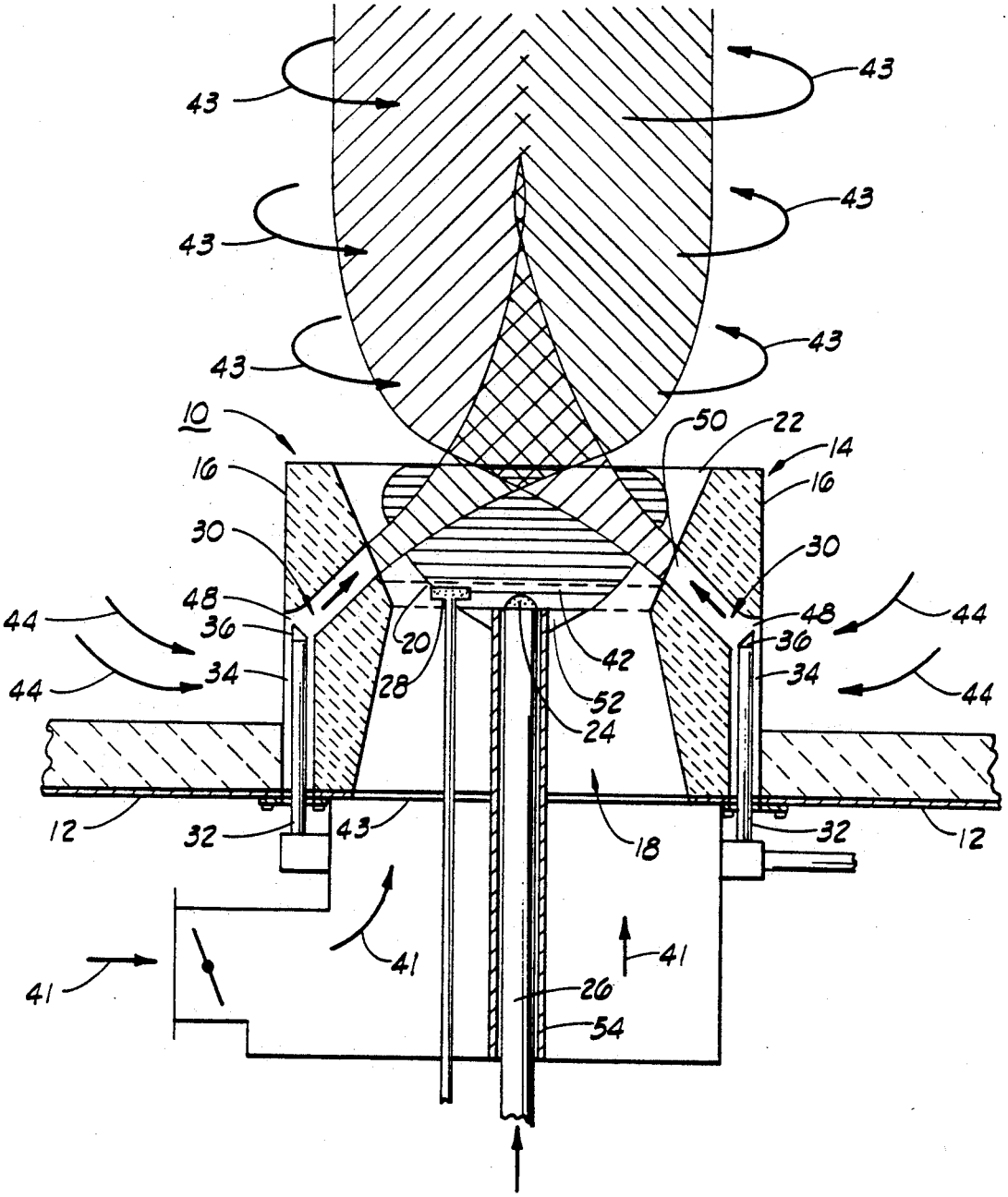
FIG. 8 is a semi-detailed, partially cutaway, partially diagrammatical representation, in elevation, of the burner assembly of FIG. 1 illustrating an ignition flame and a flame envelope resulting from ignition of fuel/-diluent streams intermingling with the ignition flame during operation of the burner assembly.
Figure 3:
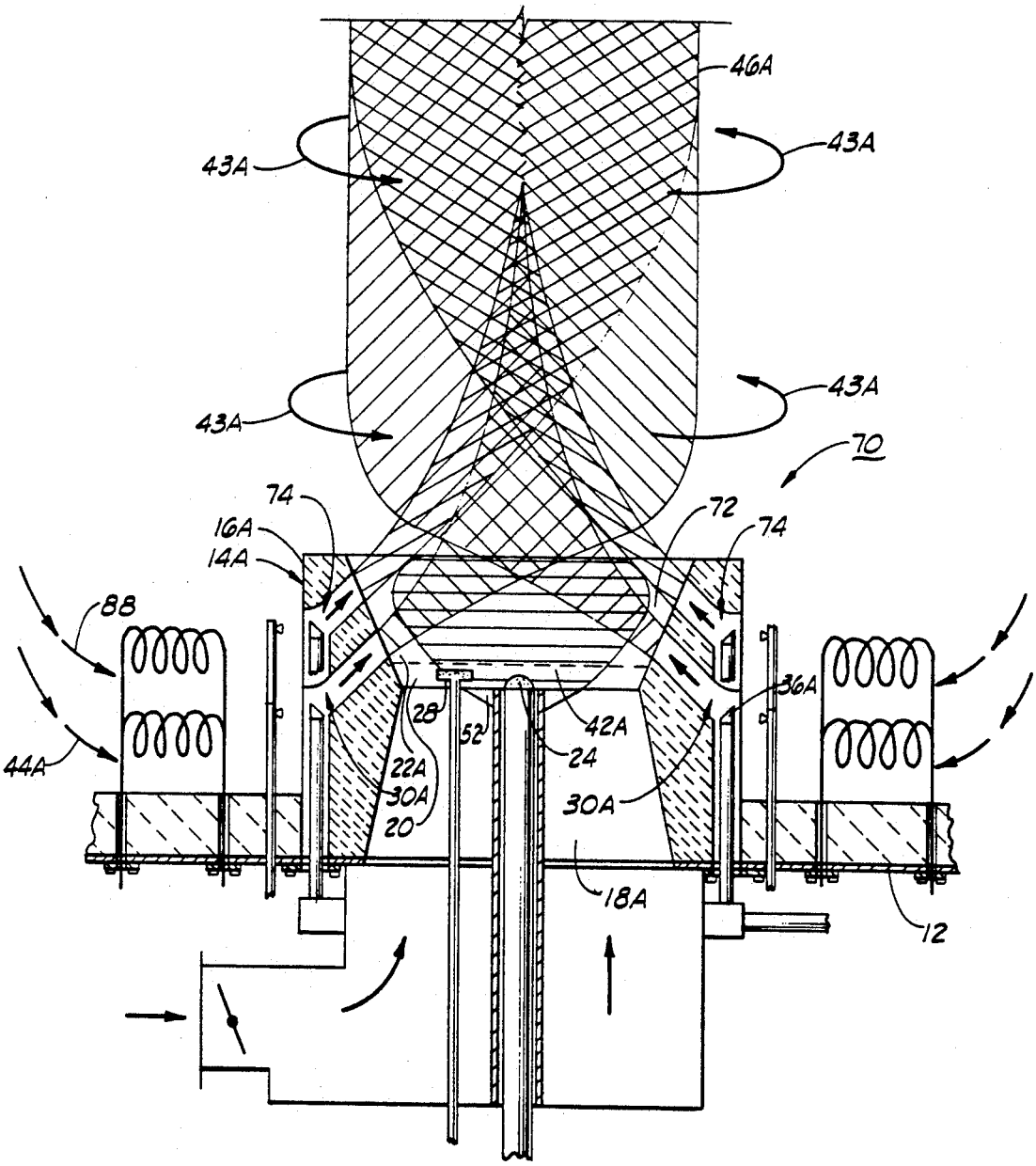

FIGS. 8 and 9

For a better understanding of the flame dynamics of the present invention, the burner assembly 10 is shown in FIG. 8 in which also depicted are the ignition flame 42 and the flame envelope 46 as these are established and maintained by the fuel from the ignition nozzle 24 and by the fuel/diluent streams from the meter channels 30. These flames are cross hatched to depict the source of each and the intermingling thereof.

As mentioned above, the total combustion air is passed through the burner throat 18 of the burner assembly 10 and turbulently and intimately admixed with the fuel/diluent streams introduced into the mixing zone 22. Because of the swirl angles, orientation and shapes of the meter channels 30, a rotational motion is imparted to the resulting fuel stream/combustion air mixture in the burner throat 18, and this effects a rotational motion of the flame envelope 46 in the firebox of the furnace, as depicted by arrows 43 in FIG. 8. The ignition flame 42, which produces a temperature and sufficient thermal energy to ignite the fuel/diluent-/combustion air mixture in the mixing zone 22 of the burner throat 18, is cross-hatched, as is the fuel/diluent-/combustion air mixture produced in the burner throat 18 and extending upwardly into the firebox of the furnace so as to schematically depict the turbulent and intimate admixing of the combustion air with the fuel/-diluent streams.

As depicted in FIG. 8, the ignition flame 42 is a stable flame unaffected at its base by the injection of the fuel/-diluent streams from the meter channels 30. The turbulently revolving fuel/diluent/streams are admixed with combustion air (and with the combustion products from the ignition flame 42, which represent a minor part of the total mass flow), and the resulting mixture is ignited by the ignition flame 42. The combustion of the fuel/-diluent/combustion air mixture, commenced in the burner throat 18, continues as the mass flows into the furnace cavity, establishing the flame envelope 46.

Similarly, FIG. 9 shows the burner assembly 70 having imposed thereon the flame envelope 46A depicted as spinning by arrows 43A. In the burner assembly 70, the total combustion air is passed through the burner throat 18A and is mixed with the primary and secondary fuel streams introduced via the meter channels 30A, 74 into the first and second mixing zones 22A, 72 in the burner throat 18A. The turbulently revolving fuel/diluent streams are admixed with combustion air (and with the combustion products from the ignition flame 42A), and the resulting mixture is ignited by the "building effect" in the burner throat 18A. This combustion, commenced in the burner throat 18A, continues as the mass flows into the furnace cavity, establishing the flame envelope 46A.

The ignition flame 42A, unaffected at its base by the injection of the fuel/diluent streams from the meter channels 30A, produces sufficient temperature and thermal energy to ignite the primary fuel/diluent/combustion air mixture in the mixing zone 22A of the burner throat 18. This ignition flame and the other flames are cross-hatched to indicate the source of each and the intermingling thereof. As the fuel/diluent streams are dispensed from the meter channels 30A, 74, the fuel/-diluent streams are caused to admix with combustion air and combustion thereof is commenced in the burner throat 18A as shown. The various cross-hatchings of these flames illustrate the combustion development and the coming together of the ignited flames to form the swirling flame envelope 46A where combustion is completed

FIGS. 10A-F and FIGS. 11A-F

Figure 10A:
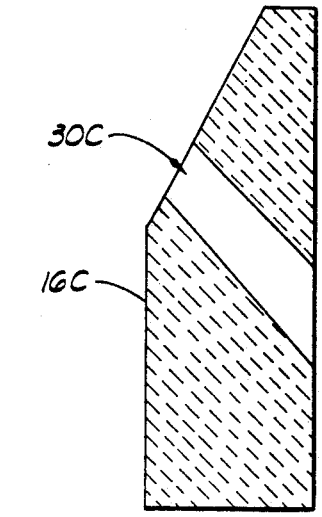
FIGS. 10A–10F are fragmental cross-sectional views of a burner member of the burner assemblies of the present invention showing various configurations of a meter channel for passing fuel/diluent streams into a mixing zone of the burner assembly.

As mentioned above, the configuration of the meter channels, designated 30 in the burner assembly 10 and 30A, 74 in the burner assembly 70, can vary, as the shape and angular disposition thereof will depend upon design and operational considerations. Several cross sectional configurations are depicted in FIGS. 10A-10F where a portion of the continuous sidewall of the burner member is illustrated having a meter channel extending therethrough. These figures illustrate a variety of cross sectional configurations for the meter channels, as follows. FIG. 10A depicts a sidewall 16C having a meter channel 30C extending therethrough. The meter channel 30C is illustrated as having an elongated shape confined within the sidewall 16C

Figure 10B:
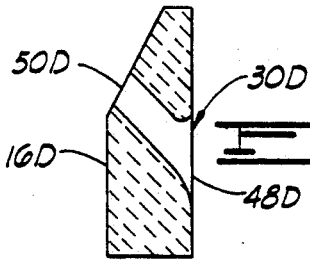
Figure 10C:
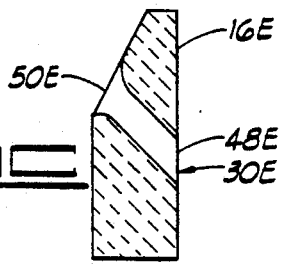

In FIG. 10B, a sidewall 16D has a meter channel 30D extending therethrough which has a flared inlet end 48D and a normal exit port 50D. FIG. 10C depicts a sidewall 16E having a meter channel 30E extending therethrough and having a normal inlet end 48E and a flared outlet port 50E.

Figure 10D:
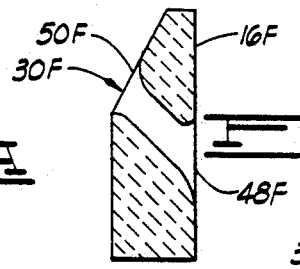
Figure 10E:
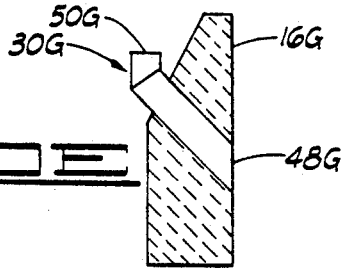
Figure 10F:
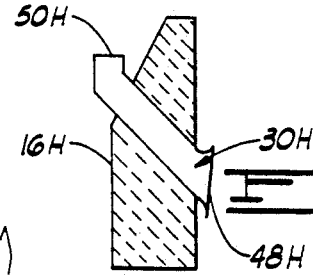

FIG. 10D depicts a sidewall 16F having a substantially venturi-shaped meter channel 30F extending therethrough having a flared inlet end portion 48F and a flared outlet port 50F. FIG. 10E depicts a sidewall 16G having a meter channel 30G extending therethrough with a normal inlet end portion 48G and an angularly disposed nozzle extending from and forming its outlet port 50G. FIG. 10F depicts a sidewall 16H having a meter channel 30H extending therethrough which is provided with a flared inlet port 48H and an angularly disposed nozzle forming its outlet port 50H.

It should be understood that the particular configuration, shape or orientation of the meter channels, such as the meter channel 30 of the burner assembly 10 and the first and second meter channels 30A and 74 of the burner assembly 70, are illustrative and are not to be considered restricted to those shown. That is, the meter channels can be provided with any configuration, shape or orientation which will enhance the admixing of the fuel and diluent to form the desired fuel/diluent stream, while at the same time providing turbulent and intimate mixing of the fuel/diluent streams with combustion air in the mixing zones of the burner throats of the burner assemblies. The meter channels can even be provided in the form of an annulus (in fact, a continuous meter channel) which extends through the burner sidewall.

Similarly, the cross sectional configuration of the meter channels of the burner assemblies of the present invention can vary. Various cross sectional configurations for meter channels, such as the meter channels 30, of the burner assembly 10 and the first and second meter channels 30A, 74 of the burner assembly 70, are illustrated in FIGS. 11A-11F.

Figure 11A:
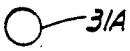
FIGS. 11A–11F illustrate various cross-sectional configurations of the meter channels of the burner assemblies of the present invention.
Figure 11B:
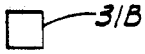
Figure 11C:
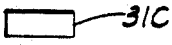
Figure 11D:
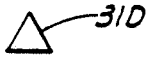
Figure 11E:
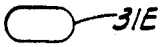
Figure 11F:
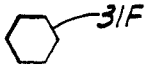

FIG. 11A illustrates a meter channel 31A having a circularly shaped cross section; FIG. 11B illustrates a meter channel 31B having a square shaped cross section; FIG. 11C illustrates a meter channel 31C having a rectangularly shaped cross section; FIG. 11D illustrates a meter channel 31D having a triangularly shaped cross section; FIG. 11E illustrates a meter channel 31E having an ovally shaped cross section; and FIG. 11F illustrates a meter channel 31F having an hexagonally shaped cross section. And as mentioned above, the meter channels can be provided in the form of an annulus extending through the burner sidewall about, and communicating with the mixing zone.

It should be understood that these cross sectional configuration of the meter channels 31A-31F are illustrative only and are not to be limited to those shown, as such meter channels can be shaped with any cross section which serves to admix fuel and diluent while also imparting turbulent and intimate mixing of the fuel/-diluent streams with combustion air in the mixing zones.

Figure 12:
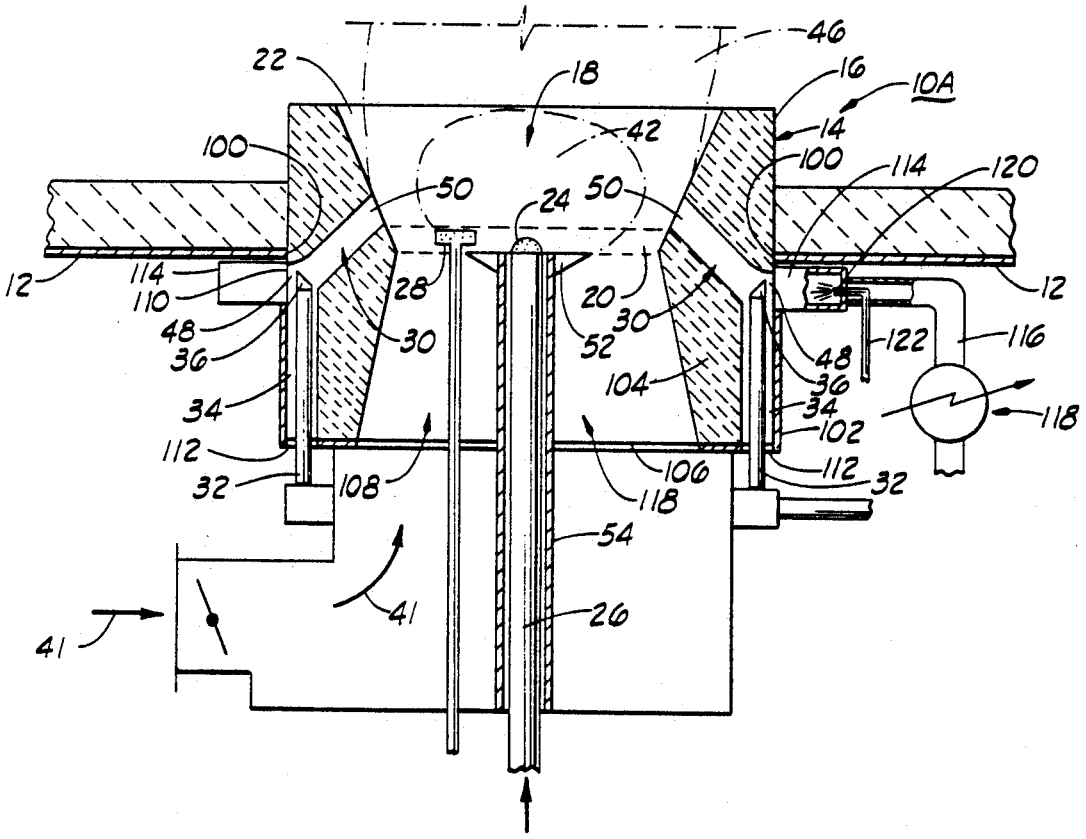
FIG. 12 is a semi-detailed, partial cutaway representation of the burner assembly of FIG. 1 modified to cool an external diluent stream prior to admixture with fuel in the meter channels of the burner member.

Embodiment of FIG. 12

Referring now to FIG. 12, a burner assembly 10A is illustrated which is identical in construction to the previously described burner assembly 10 except as described below. The burner assembly 10A is supported within an opening 100 in the floor 12 of the furnace (not shown) so that the inlet ends 48 of the meter channels 30 are disposed external to the furnace. This permits the employment of an external source of diluent to the meter channels 30 for admixture with the primary fuel gas to form the fuel/diluent stream. It will be appreciated that the burner assembly 70 illustrated in FIGS. 6 and 7 can also be supported in the manner depicted for the burner assembly 10A so that an external source of diluent can be admixed with the primary and secondary fuel in the meter channels 30A, 74 of the burner assembly 70. For brevity, however, only the burner assembly 10A and its connection to an external source of diluent will be described herein.

The burner assembly 10A includes the burner member 14 having the continuous sidewall 16 defining the burner throat, or throat bore 18, which extends through the burner member 14. The burner throat 18 is characterized as having the ignition zone 20 and the mixing zone 22 substantially as designated.

The ignition nozzle 24 is supported on the upper end of the fuel riser 26 so that the ignition nozzle 24 extends into the burner throat 18 of the burner member 14. The pilot 28 is disposed adjacent the ignition nozzle 24 so that ignition fuel discharged from the ignition nozzle 24 can be initially ignited. The meter channels 30 extend through the sidewall 16 of the burner member 14 to communicate with the mixing zone 22 in the burner throat 18. The fuel risers 32 are peripherally disposed in the grooves 34 formed in the sidewall 16 of the burner member 14. Supported on the upper ends of each of the fuel risers 34 is one of the fuel dispensing nozzles 36 which is disposed within each of the meter channels 30 substantially as shown.

A major portion of the fuel (i.e. from about 75 to about 98 percent) is dispensed from the fuel dispensing nozzles 36 into the mixing zone 22 in the burner throat 18 via the meter channels 30 as primary fuel, while a lesser or minor portion of the fuel (i.e. about 2 to about 25 percent) is dispensed from the ignition nozzle 24 into the ignition zone 20 of the burner throat 18 as ignition fuel. The total combustion air (indicated by arrows 41) required to support the ignition flame 42 and to support combustion of the fuel/diluent stream in the mixing zone 22 is passed through the burner throat 18.

The burner assembly 10A, supported in the opening 100 in the furnace floor 12, is provided with a casing or housing 102 disposed about a lower portion 104 of the burner member 14. The casing 102 is provided with a centrally disposed opening 106 corresponding to an inlet end portion 108 of the burner throat 18. Further, the casing 102 is provided with a plurality of diluent inlet openings 110, one of which openly communicates with each of the flared inlet ends 48 of the meter channels 30 substantially as shown. The fuel risers 32 supporting the fuel dispensing nozzles 36 extend through openings 112 in the casing 102 and are secured thereto so that an air tight seal is formed therebetween by any suitable manner, such as by welding.

A manifold 114 is connected to the casing 102 and aligned in fluid communication with the diluent inlet openings 110 and thus the meter channels 30, so that a diluent gas therein will be discharged to the meter channels 3 for admixture with the primary fuel. A diluent conveying conduit 116 is connected to a source of a diluent compatible with the fuel under the combustion conditions in the burner assembly 10A.

The diluent flowing through the diluent conveying conduit 116 can be cooled as required by a heat exchanger 118, or alternatively, cooling can be provided by a coolant sprayed by one or more spray nozzles 120 supported on risers 122. As discussed hereinabove, examples of suitable diluents include externally recirculated flue gas, nitrogen, steam, carbon dioxides and the like. Coker off gases or other pre-inerted, low adiabatic flame temperature gases, can also be used as diluents, but as discussed further below, such gases can themselves at times be used as fuel/diluent streams.

EXAMPLE 1

A self-metering burner assembly constructed like the burner assembly 10 of FIG. 1 was tested. The burner assembly had four fuel driven meter channels 30 and was operated under the following conditions: 10.0 MM Btu/hr, firing natural gas at 2 percent $O_2$ in the flue gas; the diluent was recirculated flue gas generated by the combustion process.

The diluent flow rate through the meter channels 30 of the burner assembly 10 was between 20–25 weight percent of the total combustion air flow. The ignition fuel was about 10 percent while the primary fuel was about 90 percent of the total fuel.

$NO_x$ data was measured using a chemiluminescent $NO_x$ analyzer. CO data was measured using a CO electrochemical cell analyzer. All data was measured as ppmvd and corrected to 3.0 percent $O_2$ in the flue gas.

Figure 13:
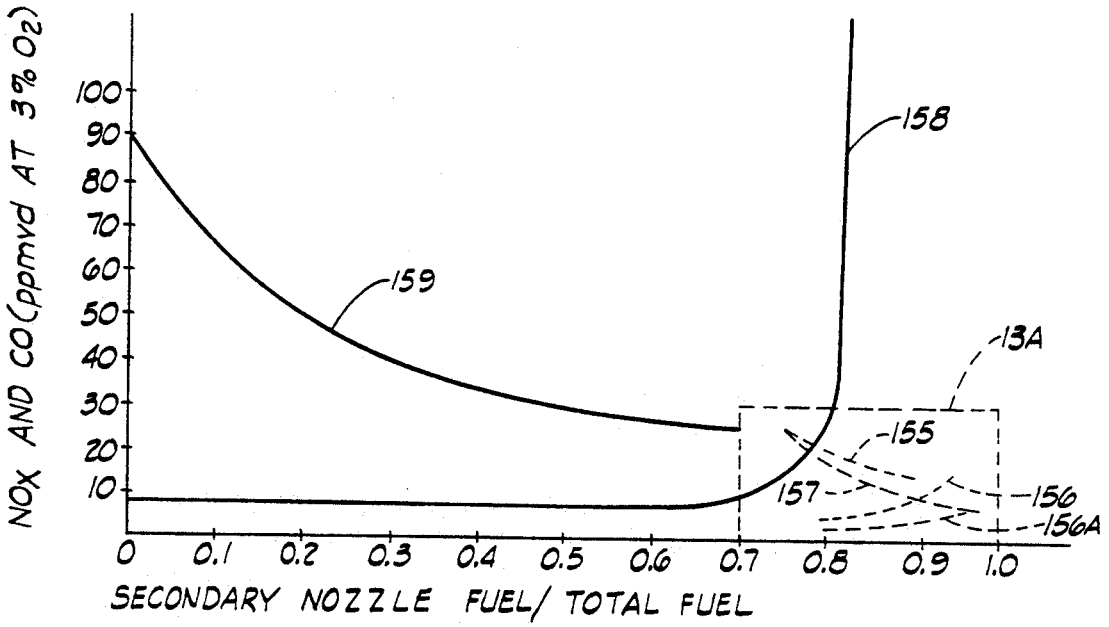
FIG. 13 is a graph depicting $NO_x$ and carbon monoxide formation data obtained by combusting a fuel in a prior art multi-stage burner assembly illustrated in FIG. 14.
Figure 13A:
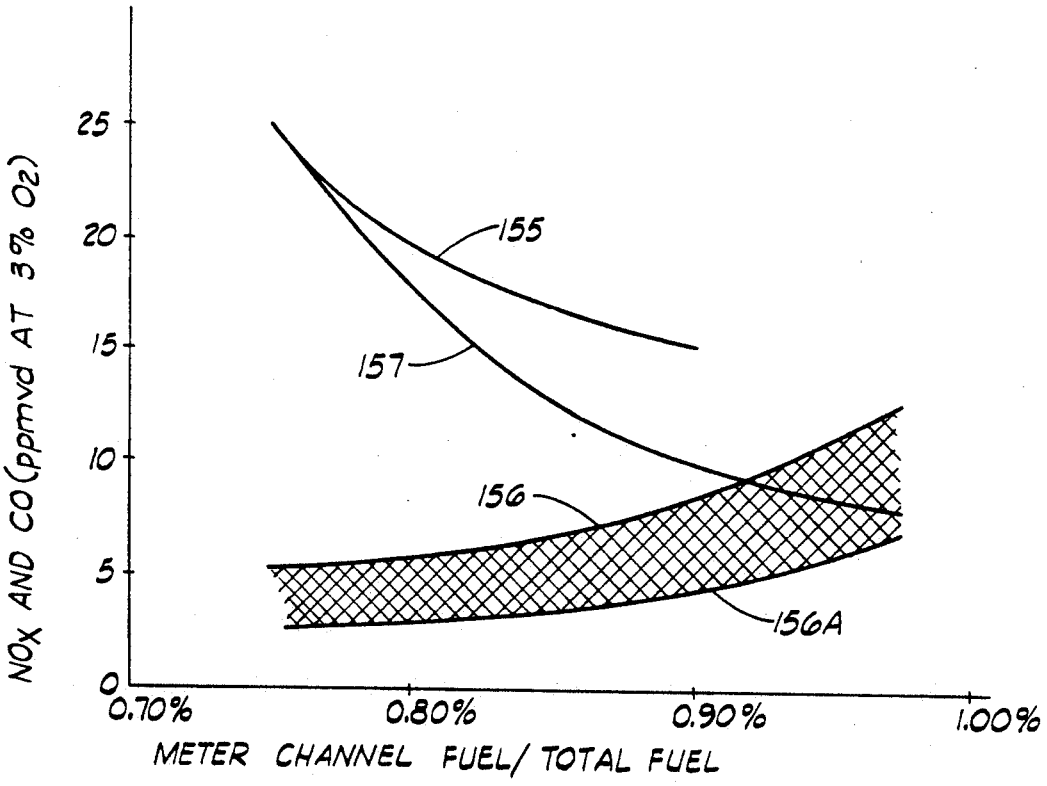
FIG. 13A is a graph depicting similar data obtained by combusting the same fuel in the burner assemblies of FIGS. 1 and 6. The curves of FIG. 13A are interposed on FIG. 13 in broken lines for a comparison of the data.

$NO_x$ and carbon monoxide formation data resulting from combustion of the natural gas fuel in the burner assembly 10 is presented in the graphs of FIGS. 13 and 13A, and the latter mentioned figure is interposed on FIG. 13. In the graphs, curve 155 represents the $NO_x$ formation and curve 156 represents the CO formation achieved by the burner assembly 10 during the test for this example.

As shown in the graphs, the production of $NO_x$ and carbon monoxide was minimal, i.e. less than about 15 to 25 ppmvd $NO_x$ and from about 5 to 15 ppmvd carbon monoxide. Further, with about 90 percent of the fuel injected as primary fuel into the mixing zone 22 of the burner throat 18, the flame was stable through the entire range of turndown during the operation of the burner assembly 10, as shown by a better than a 10 to 1 turndown ratio.

EXAMPLE 2

A 10.0 MM Btu/hr self-metering burner assembly 70 (FIG. 6) having four fuel driven meter channels 30A and four fuel driven meter channels 74, was tested, firing natural gas at 2 percent $O_2$ in the flue gas. The diluent was recirculated flue gas generated by the combustion process.

The diluent flow rate through the first and second mixing zones 22A, 72 of the burner assembly 70 was about 30 weight percent of the total combustion air flow. That is, the diluent flow rate through the first meter channels 30A for admixture with the combustion air in the first mixing zone was about 10 percent and the diluent flow rate through the second meter channels 74 for admixture with combustion air in the second mixing zone 72 was about 20 percent, for a total combined weight percent of about 30 percent. About 5 percent of the total fuel was injected as ignition fuel to the ignition zone 20.

$NO_x$ data was measured using a chemiluminescent $NO_x$ analyzer. CO data was measured using a CO electrochemical cell analyzer. All data was measured as ppmvd and corrected to 3.0 percent $O_2$ in the flue gas.

$NO_x$ and carbon monoxide formation data resulting from combustion of the natural gas fuel in the burner assembly 70 is shown in FIGS. 13 and 13A, with the latter figure interposed on the former. In the graphs, curve 157 represents $NO_x$ formation and the range between curves 156 and 156A represents the CO formation from the test As shown by curves 157 and the range between curves 156, 156A, the formation of $NO_x$ and carbon monoxide was minimal, i.e. from about 8 to 25 ppmvd $NO_x$ and about 3 to 15 ppmvd CO. Further, with about 95 percent of the fuel injected as primary and secondary fuel to the first and second mixing zones 22A, 72 in the burner throat 18A, the flame was stable through the entire range of turndown, as shown by a better than 10 to 1 turndown ratio.

EXAMPLE 3

For comparison of the results obtained from the burner assemblies of the present invention, a typical prior art burner was tested. Prior to discussing that test it will be necessary to describe the prior art burner as depicted diagrammatically in FIG. 14.

Figure 14:
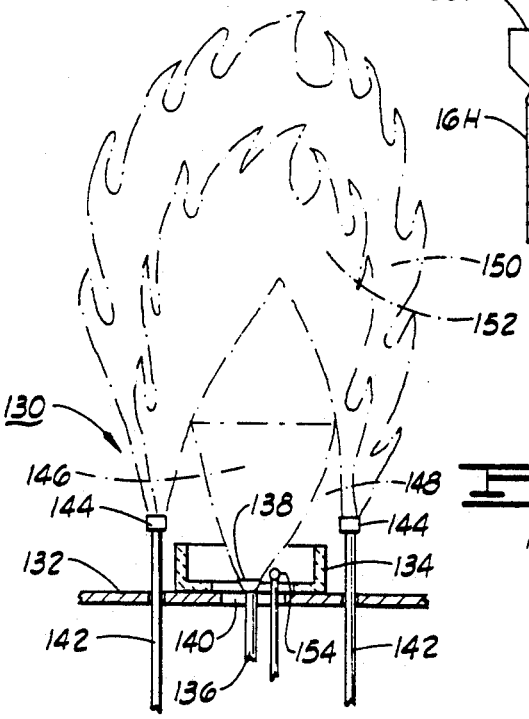
FIG. 14 PRIOR ART
FIG. 14 is a semi-detailed, partial cutaway diagrammatical representation of a typical prior art multi-stage burner assembly wherein secondary fuel is injected into the furnace.

Referring to FIG. 14, shown therein is a typical prior art staged fuel burner assembly 130 which is supported by a floor 132 of a furnace (not shown). The burner assembly 130 includes a burner tile 134. Fuel is fed via a fuel line 136 to a fuel dispensing nozzle 138 centrally disposed in the burner tile 134. Combustion air is provided through an inlet port 140 in the floor 132.

The fuel dispensing nozzle 138, referred to as the primary fuel nozzle, is centrally disposed relative to a plurality of fuel risers 142 which are peripherally disposed about the burner tile 134. Supported on the upper end of each of the fuel risers 142 is a secondary fuel dispensing nozzle 144. A major portion of fuel to be combusted is dispensed through the secondary fuel dispensing nozzles 144, while a lesser portion (at least about 25 percent) of fuel is dispensed through the primary fuel dispensing nozzle 138. Combustion air provided via the inlet port 140 produces a combustion flame 146 in a primary flame zone 148 and a flame envelope 150 in a secondary flame zone 152 within the furnace.

Upon ignition of the primary fuel by a pilot 154 the combustion flame 146 is created in the primary flame zone 148; and the secondary fuel is ignited in the furnace. That is, the secondary fuel is injected by the secondary fuel dispensing nozzles 144 downstream of the primary flame zone 146 and external to the burner tile 134. Any mixing of the secondary fuel with recirculated flue gas in the furnace cavity is random and is miniscule in most furnaces. Further, in a staged fuel burner assembly of the type illustrated in FIG. 14, high primary fuel heat release (generally 25 percent or greater) is necessary for stable combustion of the secondary fuel which is injected into the furnace cavity.

The lowering of $NO_x$ formation in the combustion of a fuel in a prior art staged fuel burner is limited because, as one lowers the $NO_x$ formation to about the 20–30 ppmvd range by either lowering the primary heat release or increasing the distance between the primary and secondary flame zones, carbon monoxide production increases rapidly, thereby rendering such an apparatus and process unacceptable.

A staged fuel burner, as depicted in FIG. 14, was fired using natural gas at 2 percent $O_2$ in the flue gas. This burner was fired to establish base line operating limits of existing staged fuel technology.

$NO_x$ data was measured using a chemiluminescent $NO_x$ analyzer. CO data was measured using a CO electrochemical cell analyzer. All data was measured as ppmvd and corrected to 3.0 percent $O_2$ in the flue gas.

The results of $NO_x$ and carbon monoxide production resulting from combustion of the natural gas fuel in the staged fuel burner assembly 130 is set forth in the curves of FIG. 13. Curve 158 shows that CO production rapidly increased when greater than about 75 percent of the fuel was injected as secondary fuel into the furnace cavity, the secondary flame zone 152, downstream of the primary flame zone 148. Curve 159 represents the results of $NO_x$ production, and as shown, the lowest NOx level was about 28 ppmvd. Further, the flame became unstable and pulsated when greater than about 80 percent of the fuel was injected as secondary fuel.

The curves of FIG. 13A are interposed on FIG. 13, although not strictly comparable due to the absissa definitions, nevertheless such curves show that the burner assemblies 10, 70 of the present invention operated in a zone of operation unattainable by prior art staged fuel burners.

Summary of Examples 1–3

The data shown in the graphs of FIG. 13 illustrates that prior art burners, such as the staged fuel burner assembly 130 of FIG. 14, operate in an entirely different region of $NO_x$ and carbon monoxide production levels than do the burner assemblies 10 and 70 of the present invention. Such prior art burners are unable to reduce the $NO_x$ below minimum levels by continuing to increase the ratio of secondary fuel/total fuel because impermissible levels of carbon monoxide are produced, and further, because the flame becomes unstable when greater than about 80 percent of the fuel is injected as secondary fuel.

On the other hand, the data in the graph of FIG. 13A (interposed on FIG. 13 for illustrative purposes) shows that the burner assemblies 10 and 70 described herein operate in a region of lower $NO_x$ and CO production which has not been achievable prior to the present invention. This is attributed to the "building effect" of the flames, and to the turbulent and intimate mixing of the fuel streams (i.e. fuel/diluent streams) and combustion air in the mixing zone 22 of the burner throat 18 of the burner assembly 10, and in the first and second mixing zones 22A, 72 of the burner throat 18A of the burner assembly 70.

Figure 15:
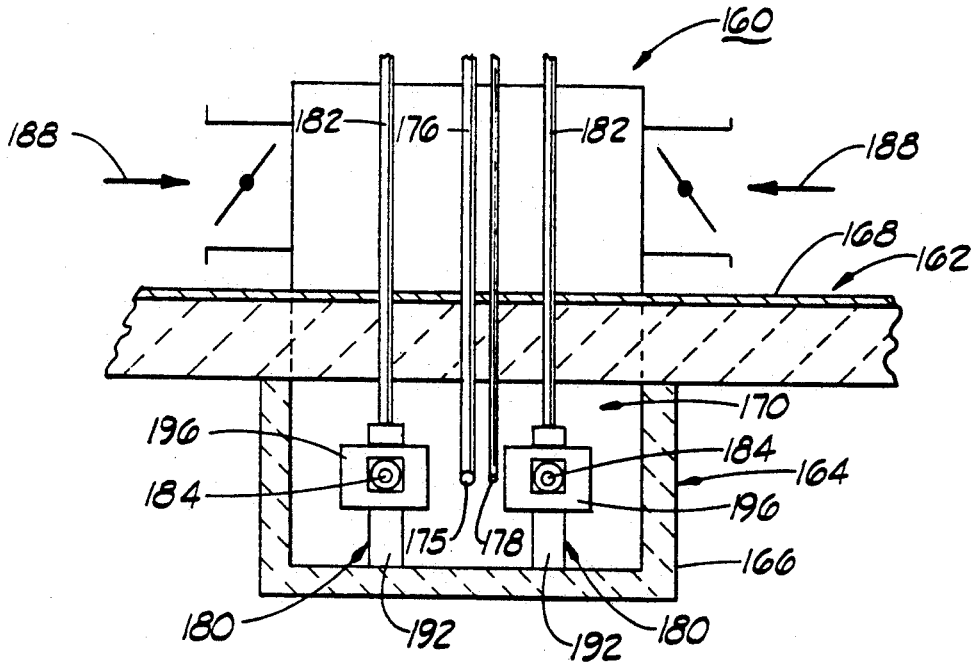
FIG. 15 is a semi-detailed, partial cutaway top plan view of another embodiment of a burner assembly constructed in accordance with the present invention.
Figure 16:
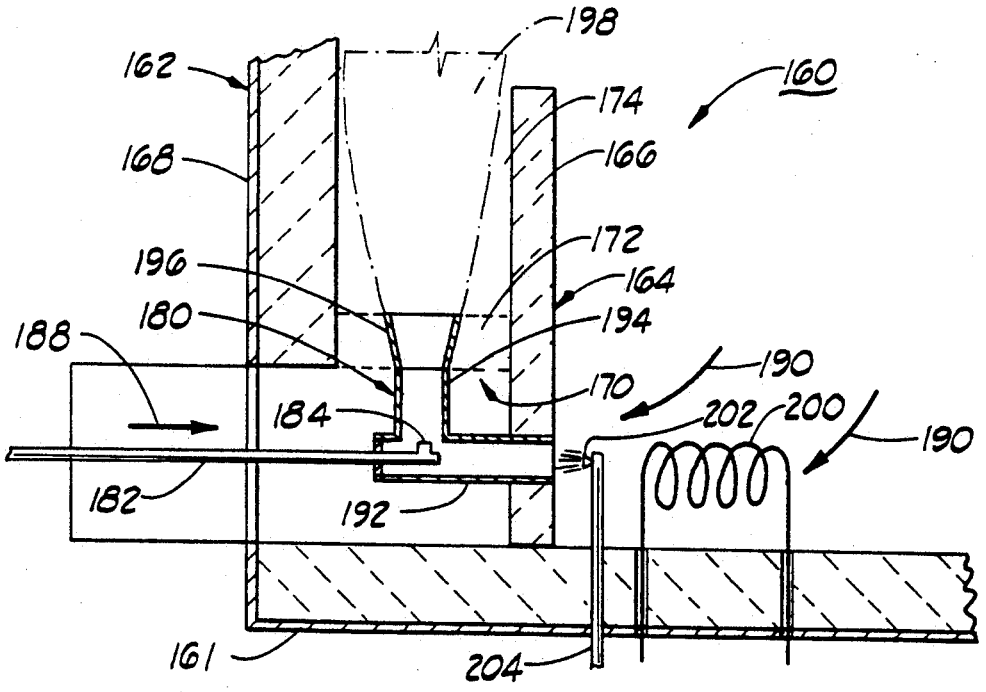
FIG. 16 is a semi-detailed, partial cutaway, partial diagrammatical side elevational view of the burner assembly of FIG. 15 having a cooling coil and spray nozzle for cooling an internally recirculated flue gas stream prior to admixture with fuel in the meter channels.
Figure 17:
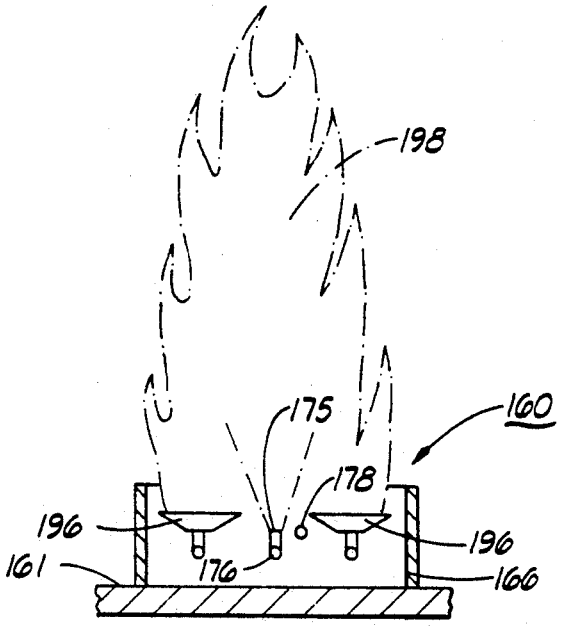
FIG. 17 is a semi-detailed, partial cutaway frontal view of the burner assembly of FIG. 15 showing a flame produced in the operation of the burner assembly.

Embodiments of FIGS. 15–17

Among the objects stated hereinabove is that of providing a process and burner assembly which is capable of achieving flame stability and substantial inhibition of $NO_x$ and CO formation, while at the same time providing the capability of shaping the combustion flame as required, to serve a wide variety of industrial combustion applications. The following discussion will be on that of the present invention as embodied in a flat flame burner assembly. It should be appreciated that while a flat flame burner assembly will be exemplified, the flame shape achievable by the present invention is nearly unlimited due to the criteria which need be manipulated for achieving any desired shape to meet the requirement of any particular industrial combustion application.

Referring now to FIGS. 15–17, shown therein is another embodiment of a self-metering burner assembly 160 constructed in accordance with the present invention. The burner assembly 160 produces a stable "flat" flame of the type required in certain furnace designs in which a long, relatively thin (flat) flame is fired along the side of a tube bank or along a refractory wall. Flat flame burner assemblies, such as the burner assembly 160, are commonly used in chemical cracking processes and in temperature sensitive processes such as coking and visbreaking.

The burner assembly 160 is supported on a floor 161 of a furnace 162 and includes a burner member 164 having sidewalls 166 which cooperate with a portion of a sidewall 168 of the furnace 162 to define a burner throat or throat bore 170. The burner throat 170 is characterized as having an ignition zone 172 and a mixing zone 174 substantially as designated.

An ignition nozzle 175, supported on one end of a fuel line 176, is disposed in the burner throat 170 of the burner member 164 so that the ignition nozzle 175 is positioned within the ignition zone 172. A pilot 178 is disposed in close proximity to the ignition nozzle 175 for initially igniting the ignition fuel discharged from the ignition nozzle 175. A plurality of meter channels 180 extend through one of the sidewalls 166 of the burner member 164 and communicate with the mixing zone 172 of the burner throat 170. A fuel line 182 extends into each of the meter channels 180, and supported on each end of the fuel lines 182 is a primary fuel nozzle 184.

Each of the meter channels 180 is characterized as having a horizontally extending inlet end portion 192 and an upwardly extending outlet end portion 194. One of the fuel dispensing nozzles 184 is positioned within the inlet end portion 192 of each of the meter channels 180 so that fuel dispensed from the fuel dispensing nozzles 184 is directed toward the outlet end portions 194 of the meter channels 180 substantially a shown. The outlet end portion 194 of each of the meter channels 180 is provided with an expansion head 196 (substantially as shown) which is disposed to communicate with the mixing zone 174 in the burner throat 170. The diverging shape of the expansion head 196 provides a reduction in velocity of the fuel/diluent stream so as to produce a low pressure zone in the mixing zone 174, and this low pressure zone causes the combustion air to be turbulently and intimately admixed with the fuel/diluent streams in the mixing zone 174 of the burner throat 170. The burner member 164 can be provided a lip portion (not shown) located at the upper end of the burner throat 170 to serve as a partial choke thereof, or other such protuberances can be disposed to extend from the burner member 164 in the burner throat 170, the purpose of which being to provide additional turbulence creating mechanisms within the burner throat 170. Such turbulence creating mechanisms are not believed necessary in most applications as sufficient turbulence is created by the discharge imparted to the fuel/diluent streams by the expansion heads 196 of the meter channels 180.

The configuration of a flame envelope 198 produced by ignition of the fuel/diluent streams in the mixing zone 174 of the burner throat 170 will be dependent upon the configuration of the expansion heads 196 and the burner throat 170. That is, when the cross sectional configuration of the burner throat 170 and the configuration of the expansion heads 196 are substantially rectangular, a substantially "flat" flame is produced; whereas, with other configurations of the burner throat 170 and the expansion heads 196, other configurations of flame can be produced.

A major portion of the fuel (i.e. from about 75 to about 98 percent) is dispensed through the primary fuel nozzles 184 and into the mixing zone 172 of the burner throat 170 via the meter channels 180 as primary fuel gas, while a lesser portion of the fuel (i.e. from about 2 to 25 percent) is dispensed through the ignition nozzle 175 into the ignition zone 172 of the burner throat 170 as ignition fuel.

The total combustion air required to support an ignition flame 186 commenced in the ignition zone 172, and to support combustion of the primary fuel/diluent streams, passes through the burner throat 170 as indicated by the arrows 188. Upon initial ignition of the ignition fuel by the pilot 178, the ignition flame 186 is established, and once the ignition flame 186 is established, the pilot 178 may be shut off. When the fuel/diluent streams are delivered to the mixing zone 174 via the meter channels 180, the fuel/diluent streams are turbulently mixed with the combustion air in the mixing zone 174. The resulting fuel/diluent/combustion air mixture is ignited by the ignition flame 186 so that the initial combustion of the fuel diluent/combustion air mixture occurs in the mixing zone 174 in the burner throat 170.

The combustion of the fuel/diluent/combustion air mixture produces combustion products exhausted as flue gas effluent from a stack section (not shown). Due to furnace effects and the combustion of the fuel/diluent streams, recirculation of a portion of a flue gas occurs within the furnace as indicated by arrows 190. The recirculated flue gas serves as diluent and is aspirated into the meter channels 180 for admixture with the primary fuel dispensed into the meter channels 180 from the primary fuel nozzles 184.

The meter channels 180 admix the recirculated flue gas and the primary fuel to produce the fuel/diluent streams. The meter channels 180 meter the fuel/diluent streams into the mixing zone 174 and into contact with the ignition flame 186. Further, because of various static and dynamic design features of the meter channels 180, the meter channels 180 meter the fuel/diluent streams.

The static design features are related to the number, size, shape and location of the meter channels 180. For example, the diluent rate can be increased for a given design by increasing the number of meter channels 180. The size of the meter channels 180 can be increased in cross sectional area and the shape of the metering channels 180 can be flared at both the inlet and outlet to improve the efficiency. The location of the meter channels 180 can be varied to change the rate of mixing of the fuel/diluent streams with the combustion air stream in the mixing zone 174 of the burner throat 170. The dynamic design features that monitor the amount of diluent flowing into the mixing zone 174 through the meter channels 180 are based on changing fuel flow and the aspirating effect associated with changing burner heat release.

The burner assembly 160 can be operated in optional modes of fuel input. In the first mode, the ignition nozzle 175 is manifolded with the primary fuel nozzles 184 so that the same fuel source services both. As fuel demand increases, the heat release from both the ignition and primary fuel nozzles 175 and 184 increases. Alternatively, as fuel demand increases, the heat release from the ignition nozzle 175 may be fixed, and the heat release from the fuel dispensing nozzle 184 may be increased. The increase in fuel gas flow from the primary fuel nozzles 184 increases the flow of diluent into the meter channels 180. This increase in fuel gas flow from the primary fuel nozzles 184, together with the increase aspiration caused by the increased mass flow with increased heat release, cause the diluent rates to increase as required to maintain the lower $NO_x$ levels as heat release increases.

In the second mode of operation, the fuel to the ignition nozzle 175 and the fuel dispensing nozzles 184 are not manifolded so that different fuel sources can be used. With varying composition fuels, this mode of operation can achieve the lowest $NO_x$ production because the ignition fuel can be natural gas, for example, and can be base loaded (held constant) at the minimum release that will ignite the fuel/diluent streams in the mixing zone 174 of the burner throat 170. The primary fuel is then controlled by heat demand. As heat demand goes up, the primary fuel flow increases in the meter channels 180. More diluent is delivered to the mixing zone 174 in the burner throat 170 because of the higher fuel flow and the increased aspiration effect.

The self metering effects of the meter channels 180 of the burner assembly 160 are further illustrated by considering a typical refinery fuel gas which can vary from 100 percent natural gas, to 75 percent $H_2$ and 25 percent $C_1$ through $C_{6+}$. This wide variance in gas composition and gas heating value causes control problems in prior art burners. However, because of the design of the burner assembly 160, the ignition fuel can be a separate, stable source of fuel gas.

As hydrogen content in a refinery fuel gas goes up, the adiabatic flame temperature goes up and therefore $NO_x$ production usually increases. However, when utilizing the burner assemblies of the present invention, as the hydrogen content goes up, so does fuel pressure for the equivalent natural gas heat release. This effect is self metering to control $NO_x$ at or below the maximum desired levels because, as the fuel pressure and velocity increase, the amount of diluent entering the mixing zones of the burner throat via the meter channels is increased.

It should be noted that while the burner assembly 160 has been illustrated as having two meter channels 180, the burner assembly 160 can be constructed so as to have only one meter channel 180 through which the fuel is injected into the mixing zone 174 of the burner throat 170 for ignition by the ignition flame 186; or the burner assembly 160 can be provided with any number of meter channels 180 for introduction of the fuel/diluent into the mixing zone 174 of the burner throat 170, and multiple ignition nozzles 175 can be provided as required.

Because temperature of the flue gas admixed with the primary fuel affects $NO_x$ production levels, it may be desirable to lower the temperature of the recirculated flue gas prior to introduction of the flue gas as diluent into the meter channels 180 of the burner assembly 160. When such is desirable, this can readily be achieved by cooling the recirculated flue gas.

Any suitable manner can be utilized to cool the recirculated flue gas, such as by the provision of a cooling coil 200 disposed to contact the recirculating flue gas as depicted in FIG. 16. Alternatively, a spray nozzle 202 as supported on a conduit 204 can be provided to spray a coolant such as water into the flue gas. Of course, the cooling coils 200 and the spray nozzles 202 can be used in combination to achieve the desired lowering of the temperature of the flue gas.

Figure 18:
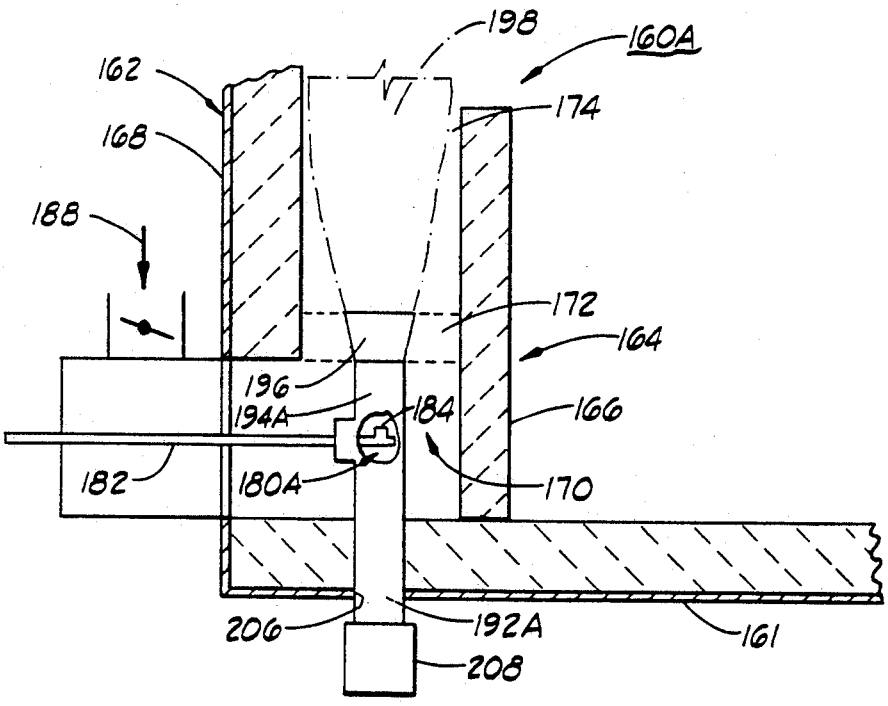
FIG. 18 is a semi-detailed, partial cutaway side elevational view of a burner assembly similar to the burner assembly of FIG. 15 and connected to an external source of a diluent for admixture with fuel in the meter channels.
Figure 19:
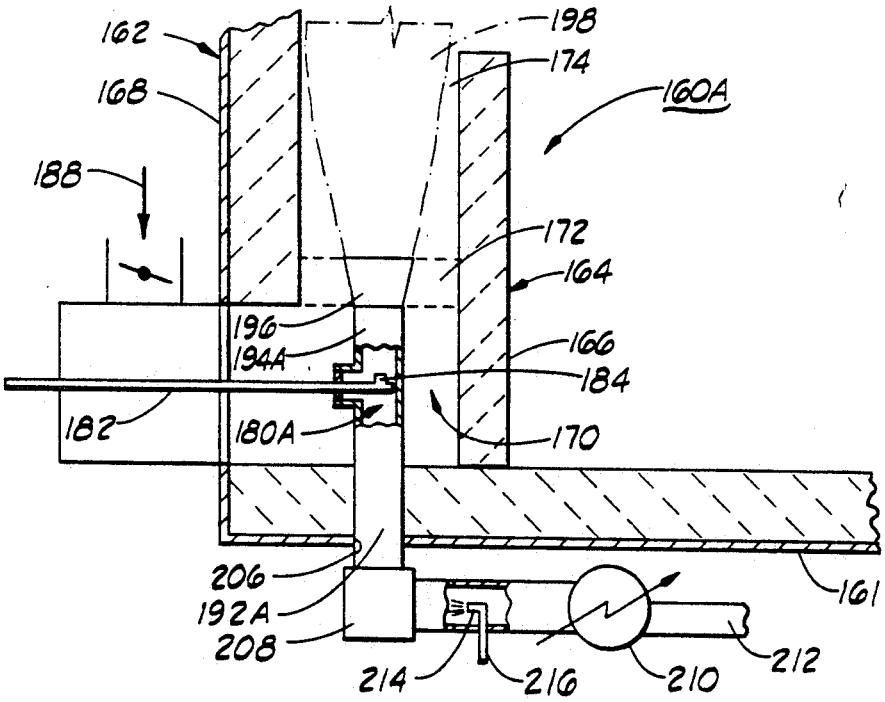
FIG. 19 is a view of the burner assembly of FIG. 18 modified to cool the diluent stream.

Embodiment of FIGS. 18-19

Referring now to FIGS. 18 and 19, a burner assembly 160A is illustrated wherein an external source of a diluent is employed as the diluent for admixing with the fuel to form the fuel/diluent streams. The burner assembly 160A is substantially identical in construction to that of the burner assembly 160 except as will be pointed out, and like numerals will be used as applicable. In the burner assembly 160A, the inlet end portions 192A of the meter channels 180A (only one shown) extends through openings 206 in the floor 161 of the furnace 162 so that outlet end portion 194A of each of the meter channels 180A is disposed within the burner throat 170 substantially as shown.

The ignition nozzle 175 (not shown in FIGS. 18-19), extends into the burner throat 170 of the burner member 164 so that the ignition nozzle 175 is positioned within the ignition zone 172 of the burner throat 170; and the pilot 178 is disposed in close proximity to the ignition nozzle 175 for igniting the ignition fuel discharged from the ignition nozzle 175 (as shown for the burner assembly 160 in FIG. 17). One of the fuel lines 182 extends into each of the meter channels 180A; and supported on the end of each of the fuel lines 182 is one of the fuel dispensing nozzle 184.

The total combustion air required to support combustion of the ignition fuel in the ignition zone 172, and to support combustion of the fuel/diluent streams, is passed through the burner throat 170 as indicated by the arrows 188. Upon the initial ignition of the ignition fuel by the pilot 178, the ignition flame 186 is established in the ignition zone 172, and the pilot 178 may then be shut off. When the fuel/diluent streams are dispensed into the mixing zone 174 via the meter channels 180A, the fuel/diluent streams are mixed with the combustion air in the mixing zone 174. The resulting fuel/diluent/combustion air mixture is ignited by the ignition flame 186 so that the initial combustion of this mixture occurs in the mixing zone 174 in the burner throat 170, and completion of the combustion occurs in the flame envelope 198 within the furnace cavity.

The inlet end portion 92A of each of the meter channels 180A is connected to a manifold 208 connected to a source (not shown) of external diluent. Thus diluent is introduced into the meter channels 180A for admixture with the fuel prior to discharge into the mixing zone 174 of the burner throat 170 via the expansion heads 196.

As previously stated, the temperature of the diluent has an effect on the production of $NO_x$, so it may be desirable for some industrial applications to incorporate a heat exchanger 210 into a diluent conveying conduit 212 attached to the manifold 208 as shown in FIG. 19. In the alternative, a spray nozzle 214 supported on a conduit 216 can be used to dispense a coolant into the diluent.

EXAMPLE 4

The burner assembly 160 was operated under the following conditions for the purpose of demonstrating the benefits thereof. A 6.0 MM Btu/hr flat flame, self-metering burner assembly 160 having two meter channels 180, two expansion heads 196, two primary fuel nozzles 184, one ignition nozzle 175 and one pilot 178 was operated with natural gas fuel at 2 percent $O_2$ in the flue gas. The diluent was recirculated flue gas generated by the combustion process, and the diluent flow rate through the meter channels 180 was between 20–25 weight percent of the total combustion air flow. The firebox temperature was measured at a point just prior to the passing of the flue gas to the stack, and the diluent temperature was measured about 1 ft. above the heater floor with an unshielded thermocouple disposed about 1 ft. away from the inlet portion 192 of the meter channel 180 as the burner assembly warmed the firebox in time.

$NO_x$ data was measured using a chemiluminescent $NO_x$ analyzer. CO data was measured using a CO electrochemical cell analyzer. All data was measured as ppmvd and corrected to 3.0 percent $O_2$ in the flue gas. Further, the ignition fuel rate was held constant at approximately 4 percent of the total burner heat release.

Figure 20:
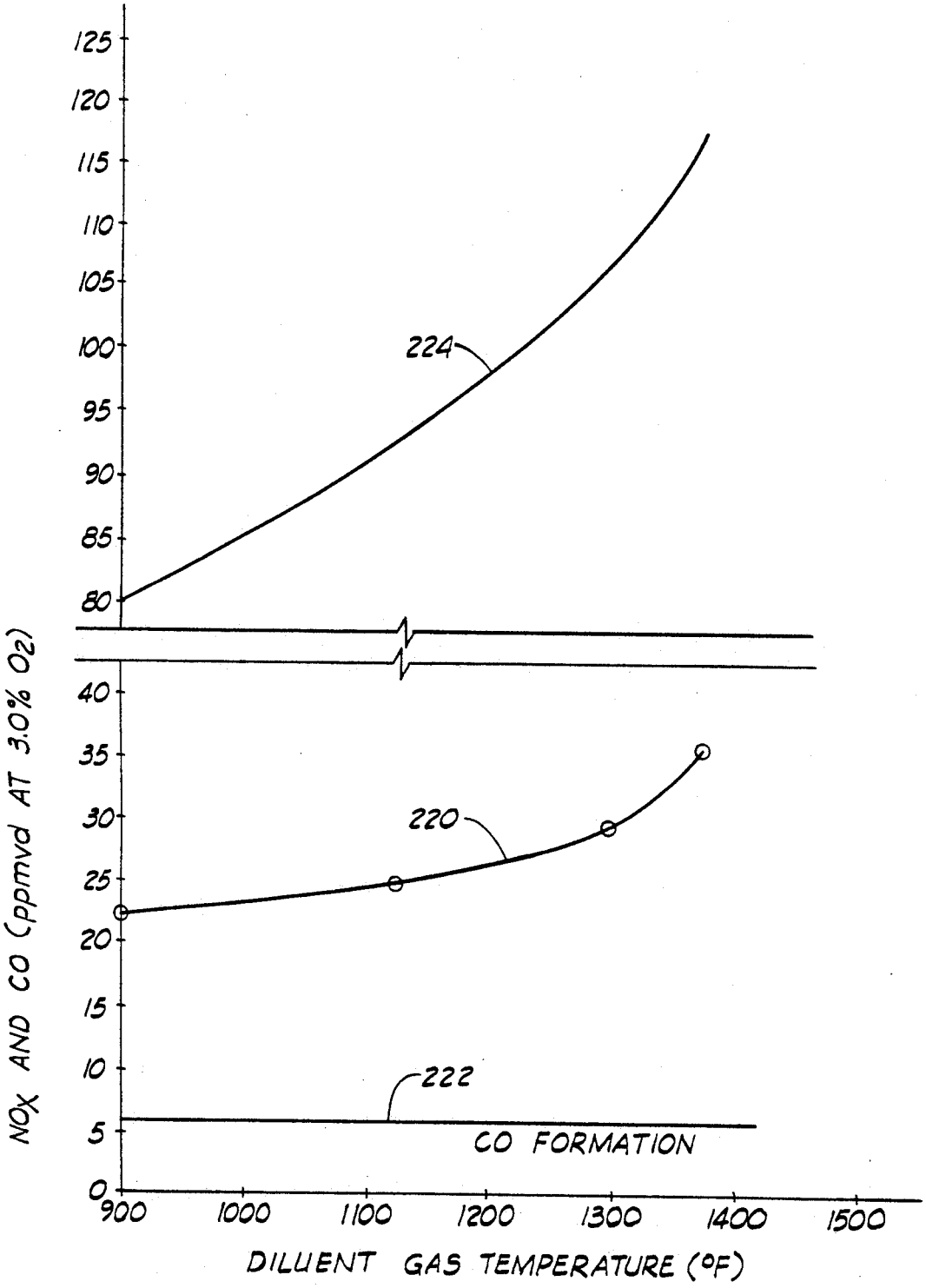
FIG. 20 is a graph depicting data obtained from the operation of a burner assembly similar to those shown in FIGS. 15–19 as compared to a prior art burner.

FIG. 20 shows the $NO_x$ and CO production as a function of the diluent gas temperature in a high temperature cracking type furnace. The firebox temperature was observed to be about 600 degrees higher than the diluent temperature which is shown along the abscissa. As the firebox warmed, the $NO_x$ rose from a valve of about 22 ppmvd at 900° F. diluent temperature to about 37 ppmvd at 1350° F. diluent temperature, as depicted by curve 220. As expected, the CO production was held at near constant 6.0 ppmvd, as depicted by curve 222, since low CO production is a characteristic of most properly designed and operated flat flame burners.

The burner assembly 160 offers the feature of diluent cooling, the significance of which being that this is a burner parameter which can be established as opposed to being a function of the heater environment as is the case for previous flat flame burners which is illustrated with the following.

A typical staged fuel, flat flame burner assembly comprises a plurality of elongated, usually tubular heads having multiple orifice outlets therealong which are directed upwardly, or substantially upwardly, so that a fuel gas is combusted having a flame shape substantially as described above for the burner assembly 160 of the present invention. Such a prior art burner assembly was operated under near identical conditions to those just described in this example, that is: at 6.0 MM Btu/hr flat flame; two primary nozzles passing the total fuel gas; a pilot; and natural gas fuel at 2 percent $O_2$ in the flue gas. Data measurement was by the same instrumentation above described, and all data was corrected to 3.0 percent $O_2$ in the flue gas. As above, the firebox temperature was observed as being about 600 degrees above the temperature of flue gas near the floor, referred to as diluent in FIG. 20 but the only such diluent affecting the flame was by random mixing in the firebox.

Curve 224 in FIG. 20 depicts the rise in $NO_x$ for this typical flat flame burner as the firebox warmed, with the $NO_x$ values rising to about 100 ppmvd and above as the firebox reached operational temperatures, with CO again represented by curve 222. Unlike the burner assembly 160 of the present invention, the diluent temperature and mixing quantity or rate are not burner controlled operating parameters for prior art burner assemblies. Rather, the diluent temperature will be that value which occurs as a function of the heater duty and the process temperature requirements associated with the particular industrial application to which the burner is dedicated. As curves 220 and 224 display, $NO_x$ generation is temperature influenced. The advantages and benefits of the present invention are clear from the lower curve 220.

FIG. 21

Figure 21:
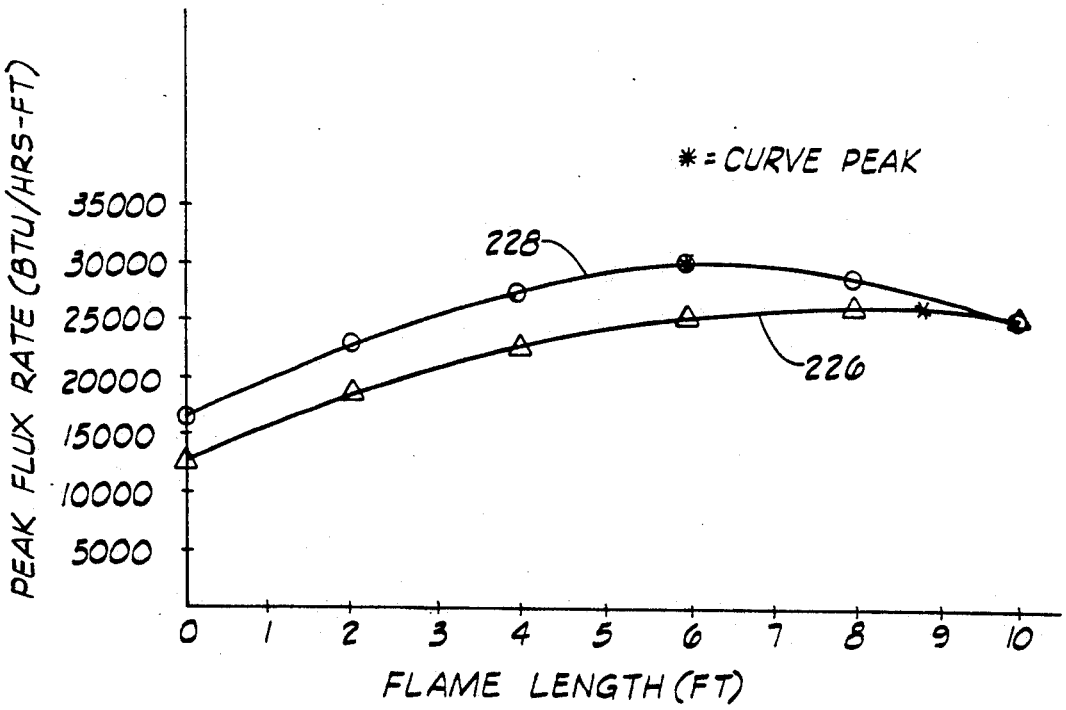
FIG. 21 is a graph depicting peak flux rate in a burner assembly according to the present invention a compared to the prior art burner assembly of FIG. 14.

An additional benefit of the present invention is demonstrated by reference to FIG. 21, that of a more uniform flux distribution and the minimization of hot spots in furnaces employing the burner assemblies described herein.

It is known that the temperature of a flame varies along its length, and as radiant heat flux is a function of the temperature to the fourth power, such temperature variations lead to varying furnace wall (or tube) temperatures. Flux rate can be determined by the predictive methods described in the book entitled "Combustion Hot Spot Analysis for Fired Process Heaters", by E. Talmor, Senior Engineering Associate, Chevron Research Company. The Talmor algorithms have proven to be useful in determining flux distributions and variations for combustion flames in process vessels, such as are created by utilization of the burner assemblies of the present invention.

The upper curve 228 in FIG. 21 depicts Talmor calculations based on the prior art burner assembly of FIG. 14, while the lower curve 226 depicts such calculations for the burner assembly 10.

The curve 228 for the prior art is based on a 10.0 MM Btu/hr single burner. The curve 226 for the present invention is also based on a 10.0 Btu/hr MM/hr single burner. That is, it was observed during actual operation of a burner assembly according to the present invention (at 10 MM Btu/hr; single burner; 2 percent excess oxygen; using natural gas as the fuel), the radiant flux was less than prior art burner assemblies. Peak flux is the highest point on each curve.

The lower profile of curve 226 (for the present invention) is expected due to the lower temperatures of the fuel/diluent combustion. However, it should be noted that the curve 226 also presents a more gradual and uniformly changing slope, with only a slight rise at its highest peak flux over the immediately adjacent areas. Further, once the peak flux has been reached, curve 226 has a more gradual decline over the rest of its length. The significance of the difference between the curves depicted in FIG. 21 is that demonstrated therein is the more uniform flux distribution and the minimization of hot spots when compared to prior art burner assemblies.

Figure 22:
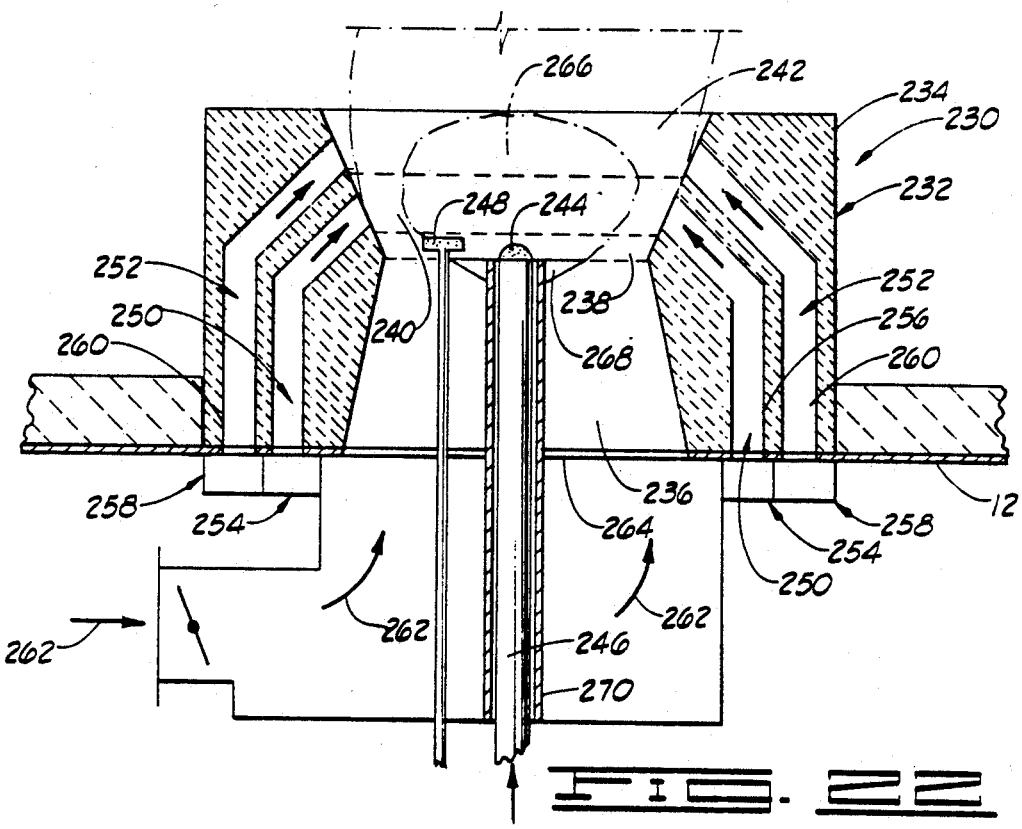
FIG. 22 is a semi-detailed, partial cutaway representation, in elevation of a burner assembly constructed in accordance with the present invention which is utilized to burn multi-waste gas streams.
Figure 23:
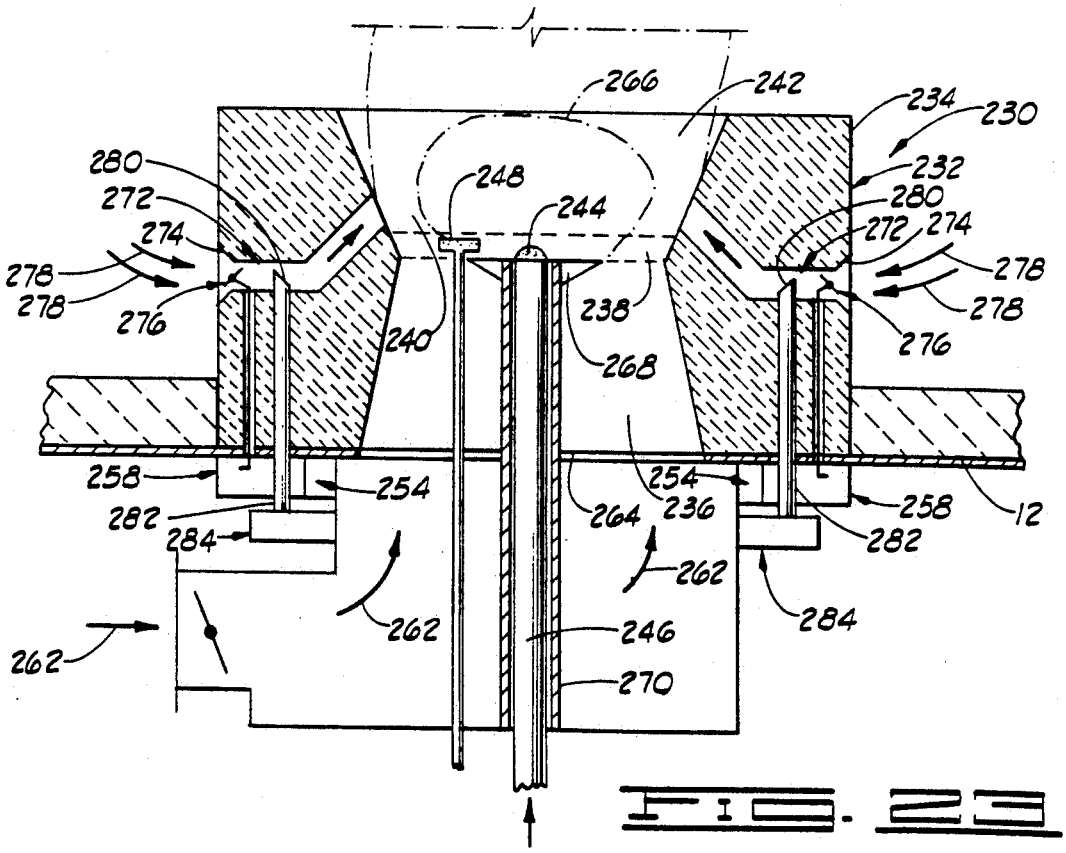
FIG. 23 is a semi-detailed, partial cutaway, partial diagrammatical representation, in elevation, of the burner assembly of FIG. 22 illustrating meter channels for introducing recirculated flue gas into the burner throat of the burner assembly.
Figure 24:
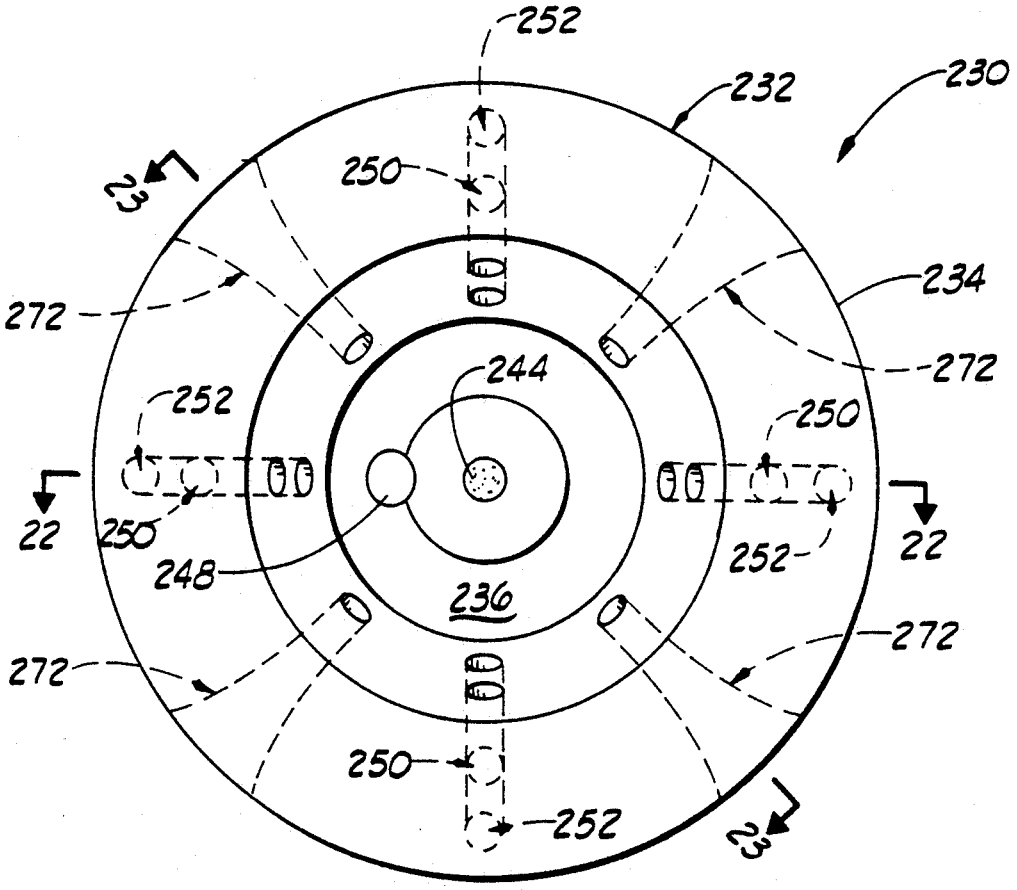
FIG. 24 is a top plan view of the burner assembly of FIG. 22. The view of the burner assembly in FIG. 22 is taken at 22—22 in FIG. 24; and the view of the burner assembly in FIG. 23 is taken at 23—23 in FIG. 24.

Embodiments of FIGS. 22–24

Referring now to FIGS. 22–24, another burner assembly 230 constructed in accordance with the present invention is illustrated. The burner assembly 230 has the unique capability of burning multi-waste gas streams which may not readily burn in conventional burner assemblies. The term waste gas stream as used herein is to be understood to be a low quality fuel gas stream having a combustible portion diluted with a significant percentage of inert components. The burner assembly 230, which is similar in construction to the burner assemblies 10 and 70, with the exceptions which will be noted hereinafter, achieves stable combustion of a wide variety of waste gas streams while inhibiting the generation of $NO_x$ and CO.

The burner assembly 230 is supported on the floor 12 of a furnace (not shown) and includes a burner member 232 having a continuous sidewall 234 which defines a burner throat or throat bore 236. The burner throat 236 defines an ignition zone 238, a first mixing zone 240 and a second mixing zone 242 substantially as shown. Further, the burner throat 236 has a converging cross section from a lower end to the ignition zone 238 and a diverging cross section from the ignition zone 238 through the first and second mixing zones 240, 242 to the upper end of the burner throat 236. However, the burner throat 236 is not to be considered limited to such a configuration.

An ignition nozzle 244, supported on an upper end of a fuel riser 246, extends into the burner throat 236 so that the ignition nozzle 244 is positioned within the ignition zone 238 of the burner throat 236; and a pilot 248 is disposed adjacent the ignition nozzle 244 for initial ignition of the ignition fuel discharged from the ignition nozzle 244. A plurality of first meter channels 250 extend through the burner member 232 to communicate with the first mixing zone 240 in the burner throat 236; and a plurality of second meter channels 252 extend through the burner member 232 so as to communicate with the second mixing zone 242 in the burner throat 236.

The second meter channels 252 are spatially and radially displaced relative to the first meter channels 250 (FIG. 24), and as desired, the angular disposition, orientation and shape of the first and second meter channels 250, 252 can be varied in order to enhance operation of the burner assembly 230. It should be remembered that FIG. 22 is a semi-detailed diagrammatical representation, and due to the limitations of a two dimensioned drawing, the second meter channels 252 are shown immediately above the first meter channels 250. FIG. 24 depicts the second meter channels 252 radially displaced from the first meter channels 250. However, it should be understood that while the first and second meter channels 250, 252 have been shown radially displaced one from another, the first and second meter channels 250, 252 can be disposed in vertical alignment without departing from the inventive concept of the burner assembly 230.

A first manifold 254 is connected to an inlet 256 of each of the first meter channels 250 so that fluid communication is established therebetween; and a second manifold 258 is connected to an inlet end 260 of each of the second meter channels 252. The first and second manifolds 254, 258, are each connected to a source (not shown) of a waste gas stream to be burned in the burner assembly 230. As can be appreciated, the source of waste gas can be a single source, or can be several completely different and distinct waste gas streams. Further, while the burner assembly 230 has been illustrated as containing two manifolds and first and second meter channels 250, 252, it should be understood that the number of meter channels employed can be varied depending upon the design criteria for any particular industrial application. Further, groups of meter channels can be connected to single or multiple manifolds.

When employing a multi-source of waste gas streams to be burned in the burner assembly 230, it is suggested the waste gas streams injected into the first mixing zone 240 of the burner throat 236 have a relatively higher fuel quality than the waste gas stream injected into the second mixing zone 242 in order to enhance effective operation of the burner assembly 230, while at the same time enhancing stability of the combustion process.

The fuel/waste streams introduced into the first and second mixing zones 240, 242 of the burner throat 236 will contain from about 75 to about 98 percent of the total fuel value to be burned; and an ignition fuel (which constitutes from about 2 to about 25 percent of the total fuel value burned) is dispensed through the ignition nozzle 244 into the ignition zone 238 of the burner throat 236.

All of the combustion air (indicated by the arrows 262) is introduced into the burner throat 236 via an inlet port 264 in the floor 12. The total combustion air is the amount of air required to support combustion of the ignition gas in the ignition zone 238, and to support combustion of the fuel/waste stream/air mixture in the first and second mixing zones 240, 242. That is, upon initial ignition of the ignition fuel by the pilot 248, the ignition flame 266 is established, and the pilot 248 may then be shut off. Combustion of the fuel/waste stream dispensed into the first mixing zone 240 is commenced by the ignition flame 266; and combustion of the fuel/waste stream dispensed into the second mixing zone 242 is commenced as a result of the temperature and thermal energy provided by the ignition flame 266 and ignition of the waste fuel stream in the first mixing zone 240. Thus, combustion of the waste fuel streams is started in the first and second mixing zones 240, 242 of the burner throat 236 and not within the combustion cavity of the furnace.

The amount of ignition fuel injected into the ignition zone 238 of the burner throat 236 should be that amount which is sufficient such that, upon ignition of the ignition fuel by the pilot 248, adequate temperature and thermal energy are generated by the ignition flame 266 to ignite the waste fuel stream in the first mixing zone 240. Ignition of the waste fuel stream in the first mixing zone 240 then produces an adequate temperature and sufficient thermal energy to ignite the waste fuel stream in the second mixing zone 242. This effect makes it possible to have multiple mixing zones which "build" upon each other. That is, ignition of the ignition fuel and the waste fuel stream introduced into each preceding mixing zone provides the temperature and thermal energy required to ignite and stabilize the burning of a waste fuel stream in the downstream mixing zone.

Flame stability of the burner assembly 230 can further be enhanced by providing the burner assembly 230 with a flame holder 268 supported by a guide tube 270 disposed about the fuel riser 246 so that the flame holder 268 is positioned substantially adjacent the ignition nozzle 244 as shown.

When one or more of the waste fuel streams to be burned in the burner assembly 230 generates peak flame temperatures such that $NO_x$ formation can be further reduced by adding a diluent to the waste fuel stream, such can be accomplished by incorporating into the burner assembly 230 a plurality of third meter channels 272 which extend through the sidewall 234 and communicate with the first mixing zone 240 in the burner throat 236. On the other hand, if the fuel quality of one or more of the waste fuel streams needs to be enhanced, or if a need for supplemental fuel firing for process requirements exists, a suitable fuel can be introduced into the first mixing zone 240 via the third meter channels 272.

The third meter channels 272, which are provided with a flared inlet port 274, can be provided with a damper 276 adapted to regulate the flow of recirculated flue gas (indicated by the arrows 278). A supplementary fuel nozzle 280 can be disposed within each of the third meter channels 272 substantially a shown. Each of the supplementary fuel nozzles 280 is supported on an upper end of a fuel riser 282 which is connected to a manifold 284. The manifold 284 is connected to a fuel source (not shown) so that fuel can be introduced into the third meter channels 272 via the supplementary fuel nozzles 280.

Operation

To achieve stable combustion of the waste gas stream in the first mixing zone 240, natural gas or other suitable fuel gas (i.e., ignition gas) is dispensed into the ignition zone 238 via the ignition nozzle 244. The ignition gas is then ignited by the pilot 248 to produce the ignition flame 266. The waste gas stream is then introduced into the first mixing zone 240 via the first meter channels 250 whereupon the temperature and thermal energy generated by the ignition flame 266 initially ignites the waste gas stream in the first mixing zone 240. The temperature and thermal energy generated by the initial ignition of the waste gas stream in the first mixing zone 240 then ignites the waste gas stream in the second mixing zone 242 in the burner throat 236. If supplementary fuel is required in order to achieve the process requirements, supplementary fuel is dispensed into the first mixing zone 240 via the supplementary fuel nozzles 280.

$NO_x$ and CO are monitored, and when the third meter channels 272 are incorporated into the burner assembly 230, the dampers 276 are opened until carbon monoxide is detected, and thereafter the dampers 276 are adjusted to minimize the formation of NOx without excessive production of carbon monoxide.

The enhanced stability of the burner assembly 230 is achievable because of the "building effect" of the flame. Because all of the total combustion air passes through the burner throat 236, and thus through the ignition zone 238; the ignition flame is established in a pure air environment absent any diluent. The combustion air also passes through the first mixing zone 240 and the second mixing zone 242 where ignition of each of the waste gas streams is initiated.

Flame Shaping

Certain process applications require shaped flames adapted to the equipment used. In prior art burners, such as the burner assembly 130 of FIG. 14, the shape of the flame envelope can be varied to some degree. Generally, however, the shorter the flame for a given heat release, the greater the NOx production, and the longer the flame the greater the CO formation.

The benefits of low $NO_x$ and CO formation sent invention are not limited by the shape of the flame envelope. That is, the shape of the flame envelope can be tailored to a particular heat transfer application (since the shape of the flame envelope directly affects the flux rate profile).

It is clear from the foregoing discussion that the burner assemblies of the present invention are capable of overcoming many of the problems relating to $NO_x$ and CO formation inherent with prior art burner assemblies. The burner assemblies of the present invention provide flame stability over a full operating range when combusting fuels of widely varying compositions while, at the same time, substantially inhibiting formation of $NO_x$ and CO. Further, the burner assemblies of the present invention permit one to tailor the combustion flame, as required, for a wide variety of industrial combustion applications without sacrificing the desired features of the burner.

It will be clear that the present invention is well adapted to carry out the object and attain the advantages mentioned as well as those inherent therein. While presently preferred embodiments of the invention have been described for purposes of this disclosure, numerous changes can be made which will readily suggest themselves to those skilled in the art and which are encompassed within the spirit of the invention disclosed and as defined in the appended claims.

What is claimed is:

1. A combustion process wherein a burner assembly is disposed in a furnace, the burner assembly having a burner member with a burner throat extending therethrough, the process comprising:

injecting an ignition fuel gas stream into an ignition zone formed in said burner throat;

combining a primary fuel gas stream with diluent gas to form a first fuel/diluent gas stream by injecting said primary fuel gas stream into at least one meter channel through said burner member communicating with a first mixing zone in said burner throat adjacent to and downstream of said ignition zone and with a source of said diluent gas so that said diluent gas is mixed with said primary fuel gas stream;

passing said first fuel/diluent gas stream to said first mixing zone formed in said burner throat adjacent to and downstream of said ignition zone;

combining a secondary fuel gas stream with diluent gas to form a second fuel/diluent gas stream;

passing said second fuel/diluent gas stream to a second mixing zone in said burner throat which is adjacent to and downstream of said first mixing zone; and passing the total air stream required to support combustion of said ignition fuel gas stream, said first fuel/diluent gas stream and said second fuel/diluent gas stream through said burner throat to said ignition zone so that a portion of said air stream supports combustion of said ignition fuel gas stream to produce a continuous ignition flame in said ignition zone and so that said first and second fuel/diluent gas streams are mixed with the remaining air stream whereby ignition of the mixture of said first and second fuel/diluent gas streams and the remaining air stream is commenced in said first and second mixing zones by said ignition flame.

2. The process of claim 1 wherein the step of combining a secondary fuel gas stream and diluent gas comprises:

injecting said secondary fuel gas stream into at least one second meter channel disposed to communicate with said second mixing zone said burner throat and with said source of said diluent gas so that said diluent gas is mixed with said secondary fuel gas stream to form said second fuel/diluent gas stream.

3. The process of claim 2 wherein said first and second meter channels have inlet ends disposed to communicate with said furnace so that combustion flue gas within said furnace is said source of diluent gas.

4. The process of claim 3 further comprising cooling said diluent gas prior to combining said diluent gas with said primary and secondary fuel gas streams.

5. The process of claim 4 wherein said step of cooling said diluent gas comprises injecting an inert coolant into said diluent gas.

6. The process of 1 wherein at least one of said first and second meter channels has an inlet end disposed outside said furnace and wherein diluent gas is provided thereto.

7. The process of claim 1 wherein said ignition fuel gas stream is between about 2 to 25 percent, and the sum of the primary and secondary fuel gas streams is between about 98 to 75 percent of the total fuel gas.

8. The process of claim 1 wherein said ignition fuel gas stream is between about 2 to 10 percent, and the sum of said primary and secondary fuel gas streams is between about 98 to 90 percent of the total fuel gas.

9. The process of claim 1 wherein the ignition fuel gas stream is natural gas.

10. A combustion process for minimizing the emissions of nitrogen oxides ($NO_x$) and carbon monoxide (CO) in a flue gas effluent from the combustion of a fuel in a burner assembly disposed in a furnace, the process comprising:

passing the total combustion air stream through a burner throat extending through said burner assembly, an ignition zone and first and second mixing zones formed in said burner throat;

injecting an ignition fuel gas stream into said ignition zone;

igniting said ignition fuel gas stream and a first portion of said combustion air stream to create a continuous ignition flame in said ignition zone;

injecting a primary fuel gas stream into said first mixing zone in said burner throat;

injecting diluent gas into said first mixing zone in said burner throat;

mixing aid primary fuel gas stream and diluent gas with a second portion of said combustion air in said first mixing zone to form a primary fuel/diluent-/combustion air mixture so that ignition of the primary fuel/diluent/combustion air mixture is commenced by the ignition flame in the burner throat;

injecting a secondary fuel gas stream into said second mixing zone in said burner throat;

injecting diluent gas into said second mixing zone in said burner throat; and mixing said secondary fuel gas stream and diluent gas with the remaining combustion air in said second mixing zone to form a secondary fuel/diluent/combustion air mixture so that ignition of said secondary fuel/diluent/combustion air mixture is commenced by the flame of the primary fuel/diluent-/combustion air mixture commenced in said first mixing zone.

11. The process of claim 10 wherein said diluent gas comprises combustion flue gas internally recirculated in said furnace.

12. The process of claim 11 further comprising cooling said diluent gas prior to injecting said diluent gas into said mixing zones of said burner throat.

13. The process of claim 12 wherein the step of cooling said diluent gas comprises injecting an inert coolant into said diluent gas.

14. The process of claim 10 wherein said diluent gas is provided external to said furnace.

15. The process of claim 10 wherein said ignition fuel gas stream is between about 2 to 25 percent, and the sum of said primary and secondary fuel gas streams is between about 98 to 75 percent of the total fuel gas.

16. The process of claim 10 wherein said ignition fuel gas stream is between about 2 to 10 percent, and the sum of said primary and secondary fuel gas streams is between about 98 to 90 percent of the total fuel gas.

17. The process of claim 10 wherein the ignition fuel gas stream is natural gas.

18. The process of claim 10 wherein said ignition fuel gas stream, said primary fuel gas stream and said secondary fuel gas stream are from a common fuel gas source.

19. A self-metering burner assembly capable of inhibiting nitrogen oxides ($NO_x$) and carbon monoxide (CO) formation in a furnace flue gas discharge, the burner assembly comprising:

burner means for passing the total combustion air through a burner throat bore in which are formed an ignition zone and first and second mixing zones adjacent and downstream to the ignition zone;

ignition means for igniting an ignition fuel gas to establish a continuous ignition flame in said ignition zone;

fuel mixing and metering means communicating with said first mixing zone of said burner throat bore for admixing a primary fuel gas and a diluent gas to form a first fuel/diluent gas stream and for metering said first fuel/diluent gas stream into said first mixing zone;

second fuel mixing and metering means communicating with said second mixing zone of said burner throat for admixing a secondary fuel gas and a diluent gas to form a second fuel/diluent gas stream and for metering said second fuel/diluent gas stream into said second mixing zone; and air inlet means for providing said combustion air through said burner throat bore so that said ignition flame is commenced in said ignition zone, combustion of said first fuel/diluent gas stream is commenced in said first mixing zone by ignition thereof by said ignition lame and combustion of said second fuel/diluent gas stream is commenced in said second mixing zone.

20. The burner assembly of claim 19 wherein said first and second fuel mixing and metering means comprise a plurality of first and second meter channels extending through said burner means into said burner throat bore and peripherally disposed thereabout.

21. The burner assembly of claim 20 wherein each first and second meter channel has an inlet end and an outlet end, and said first and second fuel mixing and metering means further comprise:

a plurality of primary and secondary fuel risers; and a plurality of fuel dispensing nozzles, one each of such fuel dispensing nozzles being supported by one of said primary and secondary fuel risers and disposed thereby at the inlet end of one of said first and second meter channels so that diluent gas is aspirated through said first and second meter channels when fuel is dispensed by the fuel dispensing nozzles.

22. The burner assembly of claim 21 wherein each of said first and second meter channels are characterized as having a flared inlet portion.

23. The burner assembly of claim 21 wherein said flared inlet portions of said first and second meter channels are disposed within said furnace so that said diluent gas therein is internally recirculated flue gas.

24. The burner assembly of claim 21 wherein said flared inlet portions of said second meter channels are disposed outside of said furnace, and wherein said burner assembly further comprises means for communicating an external diluent source to said flared inlet ends of said second meter channels.

25. The burner assembly of claim 24 further comprising cooling means for cooling diluent gas passing to said inlet ends of said second meter channels.

26. The burner assembly of claim 25 wherein said cooling means comprises coolant injection means for injecting a coolant into said diluent gas to said second meter channels.

27. The burner assembly of claim 23 further comprising cooling means for cooling diluent gas passing to said inlet ends of said second meter channels.

28. The burner assembly of claim 27 further comprising coolant injection means for injecting a coolant into said diluent gas to said second meter channels.

29. The burner assembly of claim 19 further comprising manifold means for passing a common source of fuel to said ignition means, to said first fuel mixing and metering means and to said second fuel mixing and metering means so that said ignition fuel, primary fuel and secondary fuel gas streams are of the same constituency.

* * * * *

UNITED STATES PATENT AND TRADEMARK OFFICE

CERTIFICATE OF CORRECTION

PATENT NO. : 5,284,438

DATED : February 8, 1994

INVENTOR(S) : Eugene C. McGill et al.

It is certified that error appears in the above—identified patent and that said Letters Patent is hereby corrected as shown below:

Column 1, line 15, delete the word "glass" and substitute the word --gases--

Column 21, line 45, delete the numeral "3" and substitute the numeral --30--

Column 28, line 30, delete the numeral "92A" and substitute the numeral --192A--

Column 33, line 30, after "formation" and before "sent" insert --provided

Column 35, line 12, delete the word "aid" and substitute the word --said--

Column 36, line 15, delete the word "lame" and substitute the word --flame--

UNITED STATES PATENT AND TRADEMARK OFFICE

CERTIFICATE OF CORRECTION

PATENT NO. : 5,284,438
DATED : February 8, 1994
INVENTOR(S) : Eugene C. McGill, et al.

It is certified that error appears in the above-indentified patent and that said Letters Patent is hereby corrected as shown below:

Column 36, line 43, delete the numeral "21" and substitute the numeral --22--.

Signed and Sealed this

Thirtieth Day of August, 1994

*Attest:*

*Attesting Officer*

Bruce Lehman

BRUCE LEHMAN

*Commissioner of Patents and Trademarks*